US012129075B2

(12) United States Patent
Bryant et al.

(10) Patent No.: US 12,129,075 B2
(45) Date of Patent: Oct. 29, 2024

(54) APPARATUS FOR STORING AND EXTRACTING AN EDIBLE SUBSTANCE

(71) Applicant: Ethyl Ambrosia LLC, Austin, TX (US)

(72) Inventors: DeAnna Bryant, Austin, TX (US); Gill Martinez, Aurora, CO (US)

(73) Assignee: Ethyl Ambrosia LLC, Austin, TX (US)

( * ) Notice: Subject to any disclaimer, the term of this patent is extended or adjusted under 35 U.S.C. 154(b) by 576 days.

(21) Appl. No.: 17/067,557

(22) Filed: Oct. 9, 2020

(65) Prior Publication Data

US 2021/0107700 A1 Apr. 15, 2021

Related U.S. Application Data

(60) Provisional application No. 62/913,424, filed on Oct. 10, 2019.

(51) Int. Cl.
*B65D 21/08* (2006.01)
*B65D 21/02* (2006.01)
(Continued)

(52) U.S. Cl.
CPC ..... *B65D 21/086* (2013.01); *B65D 21/0217* (2013.01); *B65D 25/02* (2013.01); *B65D 85/72* (2013.01)

(58) Field of Classification Search
CPC .. B65D 21/086; B65D 21/0217; B65D 25/02; B65D 85/72; B65D 2543/00092;
(Continued)

(56) References Cited

U.S. PATENT DOCUMENTS 1,943,866 A * 1/1934 Holl ..... A47G 19/2255 215/377
1,986,958 A * 1/1935 Cooperstein ..... A47G 19/2255 215/377

(Continued)

OTHER PUBLICATIONS

International Search Report and Written Opinion of the International Searching Authority in connection with International Application No. PCT/US2020/055291 dated Jan. 11, 2021, 10 pages.

(Continued)

*Primary Examiner* — Andrew D Perreault

(57) ABSTRACT

An apparatus for storing and extracting an edible substance includes a container including an opening at a first end of the container and an aperture disposed through a surface at a second end of the container, a platform disposed within an interior portion of the container and operable to maintain the edible substance, and a stem extending from a base to the aperture of the container, wherein the stem is operable to move through the aperture of the container, wherein the platform is operable to move from a first position in the interior portion of the container to a second position within the interior portion of the container in response to movement of the stem through the aperture of the container, and wherein, when the platform moves to the second position, the edible substance is positioned for removal from the platform and from the container.

12 Claims, 19 Drawing Sheets

(51) Int. Cl.
*B65D 25/02* (2006.01)
*B65D 85/72* (2006.01)

(58) Field of Classification Search
CPC ..... B65D 2543/00296; B65D 2543/00527; B65D 2543/00537; B65D 21/0219; B65D 21/0235; B65D 25/24; B65D 43/0202; B65D 85/76; B65D 83/0005; A47G 19/2255
See application file for complete search history.

(56) References Cited

U.S. PATENT DOCUMENTS 2,169,426 A * 8/1939 Morton ..... A47G 19/2288 215/377
2,664,004 A * 12/1953 Forman ..... A47G 19/2255 215/377
3,045,855 A * 7/1962 Lipman ..... F21V 35/00 215/377
3,482,731 A * 12/1969 Douty ..... B65D 25/24 215/377
3,528,585 A 9/1970 Kalmar
3,616,943 A * 11/1971 Brink ..... B65D 21/0235 206/508
7,007,829 B1 3/2006 Mueller et al.
2004/0020921 A1 2/2004 Hechler, IV
2005/0077303 A1* 4/2005 Minner ..... A47G 19/2255 220/574
2006/0246187 A1 11/2006 Egolf et al.
2014/0065267 A1 3/2014 Albano et al.
2017/0369198 A1 12/2017 Levy

OTHER PUBLICATIONS

Moussan, Monique, "Hot New Screw In Stick And Base Cake Push Pops," YouTube video, Feb. 25, 2014, 2 pages.

* cited by examiner

APPARATUS FOR STORING AND EXTRACTING AN EDIBLE SUBSTANCE

CROSS REFERENCE TO RELATED APPLICATIONS

This application claims priority to and the benefit of U.S. Provisional Patent Application No. 62/913,424, filed Oct. 10, 2019, entitled APPARATUS FOR STORING AND EXTRACTING AN EDIBLE SUBSTANCE, which is incorporated by reference herein in its entirety.

TECHNICAL FIELD

This disclosure is generally directed to the food or beverage containers. More specifically, this disclosure is directed to an apparatus for storing and extracting an edible substance.

BACKGROUND

Products for storing and extracting an edible substance, such as gelatin, are made from various materials and have different methods for extracting an edible substance that is stored in the product. Typically, gelatin, when combined with an alcoholic substance, is stored in paper cups, plastic cups, or plastic syringes. Often paper cups, which are made of weaker fibers, fail to store edible substances for long periods of time before losing their structure. Paper cups also do not have lids, which may cause the edible substance such as gelatin to spill during preparation when it is still in a liquid form. The absence of a lid for paper cups also makes it difficult to transport an edible substance in paper cups to the location where the user will consume the edible substance. Plastic cups, though stronger than paper cups, still have a flexible structure, which increases the potential for the edible substance spilling out of the plastic cup if stored improperly during transportation.

In addition, both paper and plastic cups require a user to determine a method for separating the edible substance from the cup, which is usually done in a messy and unsanitary manner with the user's finger or tongue. The separation of the edible substance from a paper or plastic cup can also be completed by using a utensil, which is often not readily available at various sporting and social events, where edible substances, such as gelatin combined with alcohol, are often consumed.

Another device that is sometimes used for extracting edible substances, such as gelatin combined with alcohol, is a plastic syringe. Syringes allow the user to store edible substances in a barrel and then remove the edible substance by moving the plunger or piston inside the barrel towards a nozzle at the opposite end of the syringe. This system requires the user to place his or her mouth on the nozzle of the syringe, which can be unsanitary in public environments. Additionally, because they are more expensive to produce and purchase, users often reuse syringes made to consume edible substances. Because individuals and entities that use syringes to consume edible substances often use this product multiple times, an increased possibility of cross contamination exists when using such syringes.

Therefore, there is a need for an apparatus that allows a user to store and easily consume an edible substance, such as gelatin, in a clean, affordable, and sanitary manner.

SUMMARY

In one example embodiment, an apparatus for storing and extracting an edible substance includes a container that is open at a first end and includes an aperture and one or more stops at a second end. The apparatus further includes a mobile platform operable for insertion into an interior portion of the container and operable to receive the edible substance. The apparatus further includes a stem extending from a base, wherein the stem includes one or more protrusions. The stem is operable to couple with the mobile platform inserted into the container through the aperture of the container, move between an unlocked state and a locked state, wherein, in the locked state, each of the one or more protrusions contacts one of the one or more stops, and wherein, in the unlocked state, the one or more protrusions are aligned with the aperture, and move through the aperture of the container when in the unlocked state. The mobile platform is operable to move from a first position to a second position within the interior portion of the container when the stem is moved through the aperture, and wherein, when the mobile platform is at the second position, the edible substance is removable from the mobile platform at the first end of the container.

In another example embodiment, an apparatus for storing and extracting an edible substance includes a container including an opening at a first end of the container and an aperture disposed through a surface at a second end of the container, wherein the opening of the container is operable to receive the edible substance into the container. The apparatus further includes a platform disposed within an interior portion of the container and operable to maintain the edible substance received into the opening of the container. The apparatus further includes a stem extending from a base to the aperture of the container, wherein the stem is operable to move through the aperture of the container. The platform is operable to move from a first position in the interior portion of the container to a second position within the interior portion of the container in response to movement of the stem through the aperture of the container, and wherein, when the platform moves to the second position, the edible substance is positioned for removal from the platform and from the container.

In one or more of the above examples, the first position of the platform is adjacent the surface at the second end of the container and the second position of the platform is adjacent the opening at the first end of the container.

In one or more of the above examples, the platform is coupled to the stem through the aperture of the container.

In one or more of the above examples, to couple the platform to the stem through the aperture of the container, the platform includes a peg operable for insertion through the aperture of the container and the stem includes a cavity operable to receive the peg inserted through the aperture of the container.

In one or more of the above examples, the stem includes one or more protrusions extending a distance perpendicular to a direction in which the stem extends from the base to the aperture of the container.

In one or more of the above examples, the stem is operable to move between a locked state and an unlocked state, wherein, in the locked state, each of the one or more protrusions is adjacent an underside of the surface at the second end of the container, and wherein, in the unlocked state, each of the one or more protrusions is aligned with one or more cutouts of the aperture, wherein the one or more cutouts correspond to a shape of the one or more protrusions of the stem, and wherein alignment of the one or more protrusions of the stem with the one or more cutouts of the aperture allows the one or more protrusions to pass through the one or more cutouts, and allows the stem to move through the aperture to move the platform from the first position to the second position.

In one or more of the above examples, the stem rotates between the locked state and the unlocked state.

In one or more of the above examples, the apparatus further includes one or more stops disposed on the underside of the surface at the second end of the container, wherein, in the locked state, the one or more protrusions of the stem contact the one or more stops.

In one or more of the above examples, the apparatus further includes a lid operable to be coupled to the container at the first end of the container to seal the opening of the container.

In one or more of the above examples, the lid includes one or more raised ribs disposed on an exterior surface of the lid.

In one or more of the above examples, the exterior surface of the lid includes an indented center portion operable to receive a base of another apparatus for storing and extracting an edible substance, wherein each of the one or more raised ribs are disposed around at least a portion of a perimeter of the indented center portion of the lid, and wherein the lid maintains the other apparatus in a stacked position.

In one or more of the above examples, portions of the base are operable to be stacked simultaneously on lids of a plurality of other apparatuses for storing and extracting an edible substance, wherein, when stacked, the portions of the base are each disposed between raised ribs of the lids of each of the plurality of other apparatuses.

In one or more of the above examples, the apparatus further includes a lid operable to be coupled to the container at the first end of the container to seal the opening of the container, wherein the lid includes an indented center portion on an exterior surface of the lid, the indented center portion operable to receive a base of another apparatus for storing and extracting an edible substance, and one or more raised ribs each disposed around at least a portion of a perimeter of the indented center portion of the lid, wherein the platform includes a peg operable for insertion through the aperture of the container and the stem includes a cavity operable to receive the peg inserted through the aperture of the container to couple the platform to the stem, wherein the stem includes one or more protrusions extending a distance perpendicular to a direction in which the stem extends from the base to the aperture of the container, wherein the stem is operable to rotate between a locked state and an unlocked state, wherein, in the locked state, each of the one or more protrusions is adjacent an underside of the surface at the second end of the container, wherein one or more stops are disposed on the underside of the surface of the second end of the container and the one or more protrusions contact the one or more stops when the stem is in the locked state, wherein, in the unlocked state, each of the one or more protrusions is aligned with one or more cutouts of the aperture, wherein the one or more cutouts correspond to a shape of the one or more protrusions of the stem, and wherein alignment of the one or more protrusions of the stem with the one or more cutouts of the aperture allows the one or more protrusions to pass through the one or more cutouts, and allows the stem to move through the aperture to move the platform from the first position to the second position, wherein the first position of the platform is adjacent the surface at the second end of the container and the second position of the platform is adjacent the opening at the first end of the container.

In another example embodiment, a method for storing and extracting an edible substance uses an apparatus including a container including an opening at a first end of the container and an aperture disposed through a surface at a second end of the container, a platform disposed within an interior portion of the container and that maintains the edible substance received into the opening of the container, and a stem extending from a base to the aperture of the container and coupled to the platform. The method includes receiving the apparatus including the edible substance. The method further includes moving the stem through the aperture of the container. The method further includes moving the platform, in response to the moving of the stem through the aperture of the container, from a first position in the interior portion of the container to a second position within the interior portion of the container, wherein, when the platform moves to the second position, the edible substance is positioned for removal from the platform and from the container. The method further includes extracting the edible substance from the platform.

In one or more of the above examples, the first position of the platform is adjacent the surface at the second end of the container and the second position of the platform is adjacent the opening at the first end of the container.

In one or more of the above examples, the method further includes, prior to moving the stem through the aperture of the container, moving the stem between a locked state and an unlocked state, wherein, in the locked state, each of one or more protrusions of the stem is adjacent an underside of the surface at the second end of the container, and wherein, in the unlocked state, each of the one or more protrusions is aligned with one or more cutouts of the aperture, wherein the one or more cutouts correspond to a shape of the one or more protrusions of the stem, and wherein alignment of the one or more protrusions of the stem with the one or more cutouts of the aperture allows the one or more protrusions to pass through the one or more cutouts, and allows the stem to move through the aperture to move the platform from the first position to the second position.

In one or more of the above examples, moving the stem between the locked state and the unlocked state includes rotating the stem.

In one or more of the above examples, in the locked state, the one or more protrusions of the stem contact one or more stops disposed on the underside of the surface at the second end of the container.

In one or more of the above examples, the method further includes removing a lid from the first end of the container.

In one or more of the above examples, the method further includes removing, prior to moving the stem through the aperture of the container, removing a lid from the first end of the container, and rotating, prior to moving the stem through the aperture of the container, the stem between a locked state and an unlocked state, wherein, in the locked state, each of one or more protrusions of the stem is adjacent an underside of the surface at the second end of the container and each of the one or more protrusions of the stem contact one or more stops disposed on the underside of the surface at the second end of the container, wherein, in the unlocked state, each of the one or more protrusions is aligned with one or more cutouts of the aperture, wherein the one or more cutouts correspond to a shape of the one or more protrusions of the stem, and wherein alignment of the one or more protrusions of the stem with the one or more cutouts of the aperture allows the one or more protrusions to pass through the one or more cutouts, and allows the stem to move through the aperture to move the platform from the first position to the second position, and wherein the first position of the platform is adjacent the surface at the second end of the container and the second position of the platform is adjacent the opening at the first end of the container.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like.

As used here, terms and phrases such as "have," "may have," "include," or "may include" a feature (like a number, function, operation, or component such as a part) indicate the existence of the feature and do not exclude the existence of other features. Also, as used here, the phrases "A or B," "at least one of A and/or B," or "one or more of A and/or B" may include all possible combinations of A and B. For example, "A or B," "at least one of A and B," and "at least one of A or B" may indicate all of (1) including at least one A, (2) including at least one B, or (3) including at least one A and at least one B. Further, as used here, the terms "first" and "second" may modify various components regardless of importance and do not limit the components. These terms are only used to distinguish one component from another. For example, a first user device and a second user device may indicate different user devices from each other, regardless of the order or importance of the devices. A first component may be denoted a second component and vice versa without departing from the scope of this disclosure.

It will be understood that, when an element (such as a first element) is referred to as being (operatively or communicatively) "coupled with/to" or "connected with/to" another element (such as a second element), it can be coupled or connected with/to the other element directly or via a third element. In contrast, it will be understood that, when an element (such as a first element) is referred to as being "directly coupled with/to" or "directly connected with/to" another element (such as a second element), no other element (such as a third element) intervenes between the element and the other element.

The terms and phrases as used here are provided merely to describe some embodiments of this disclosure but not to limit the scope of other embodiments of this disclosure. It is to be understood that the singular forms "a," "an," and "the" include plural references unless the context clearly dictates otherwise. All terms and phrases, including technical and scientific terms and phrases, used here have the same meanings as commonly understood by one of ordinary skill in the art to which the embodiments of this disclosure belong. It will be further understood that terms and phrases, such as those defined in commonly-used dictionaries, should be interpreted as having a meaning that is consistent with their meaning in the context of the relevant art and will not be interpreted in an idealized or overly formal sense unless expressly so defined here. In some cases, the terms and phrases defined here may be interpreted to exclude embodiments of this disclosure.

Definitions for other certain words and phrases may be provided throughout this patent document. Those of ordinary skill in the art should understand that in many if not most instances, such definitions apply to prior as well as future uses of such defined words and phrases.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the Applicant to refer to structures known to those skilled in the relevant art and is not intended to invoke 35 U.S.C. § 112(f).

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1A through 10, discussed below, and the various embodiments used to describe the principles of this disclosure in this patent document are by way of illustration only and should not be construed in any way to limit the scope of the disclosure. Those skilled in the art will understand that the principles of this disclosure may be implemented in any suitably arranged apparatus for storage and consumption of an edible substance.

As used throughout this specification, the term "edible substance" may be used to describe any item for consumption, including but not limited to gelatin and other gel-like edible products combined with alcohol, protein or meat, cheese or other dairy products, vegetables, fruit, or other produce, or any other item for consumption that can be placed within an apparatus as described in the various embodiments of this disclosure.

As the locations at which individuals meet to socialize increase, so does the need to be able to store and consume edible substances in a mess-free, affordable, and sanitary manner. A storage and extraction device such as that described herein can provide for a cost effective, sanitary, efficient, and clean method to extract edible substances from a container.

Figure 1A:
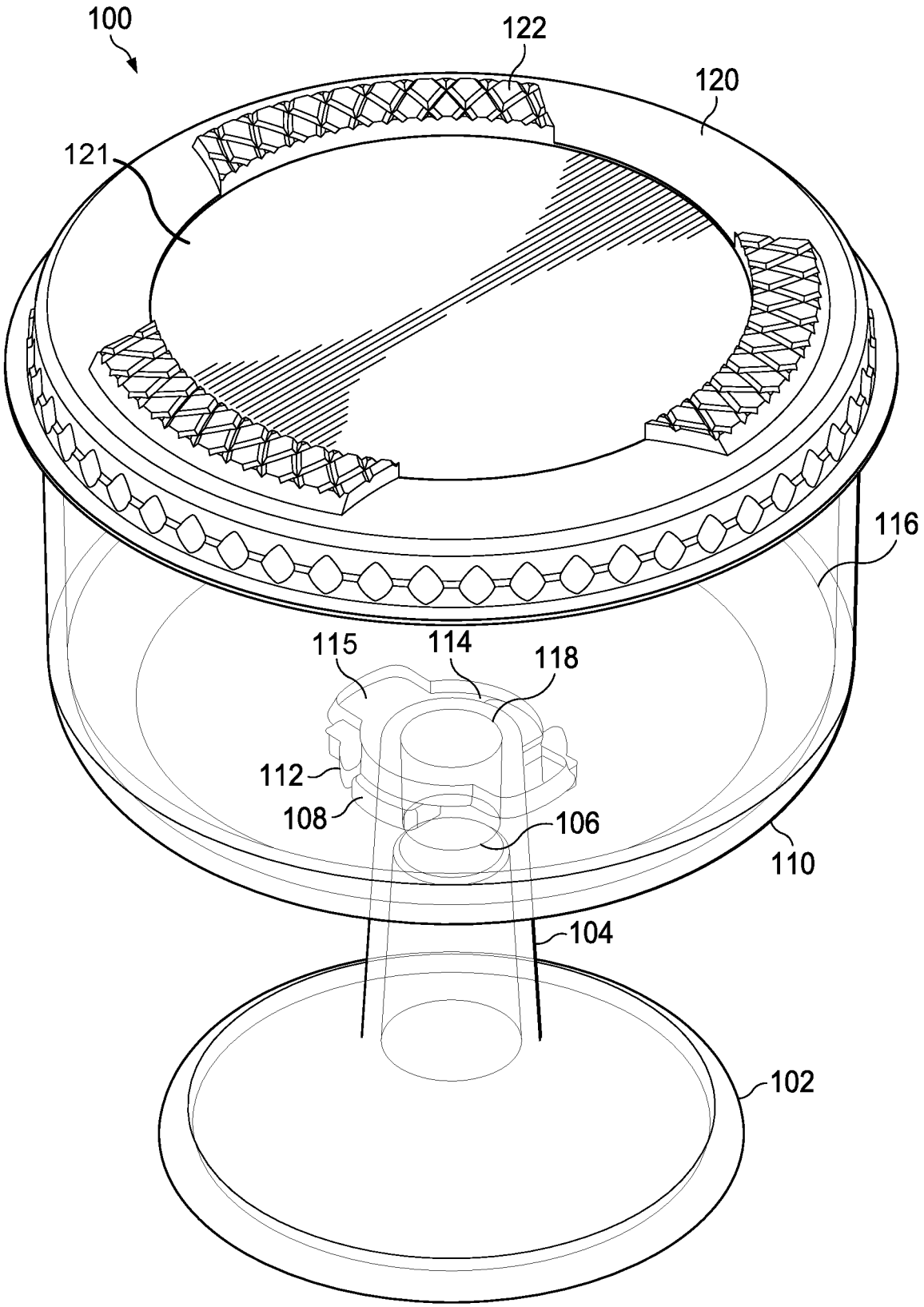
FIG. 1A illustrates a perspective view of an apparatus for storing and extracting an edible substance according to various embodiments of this disclosure.
Figure 1B:
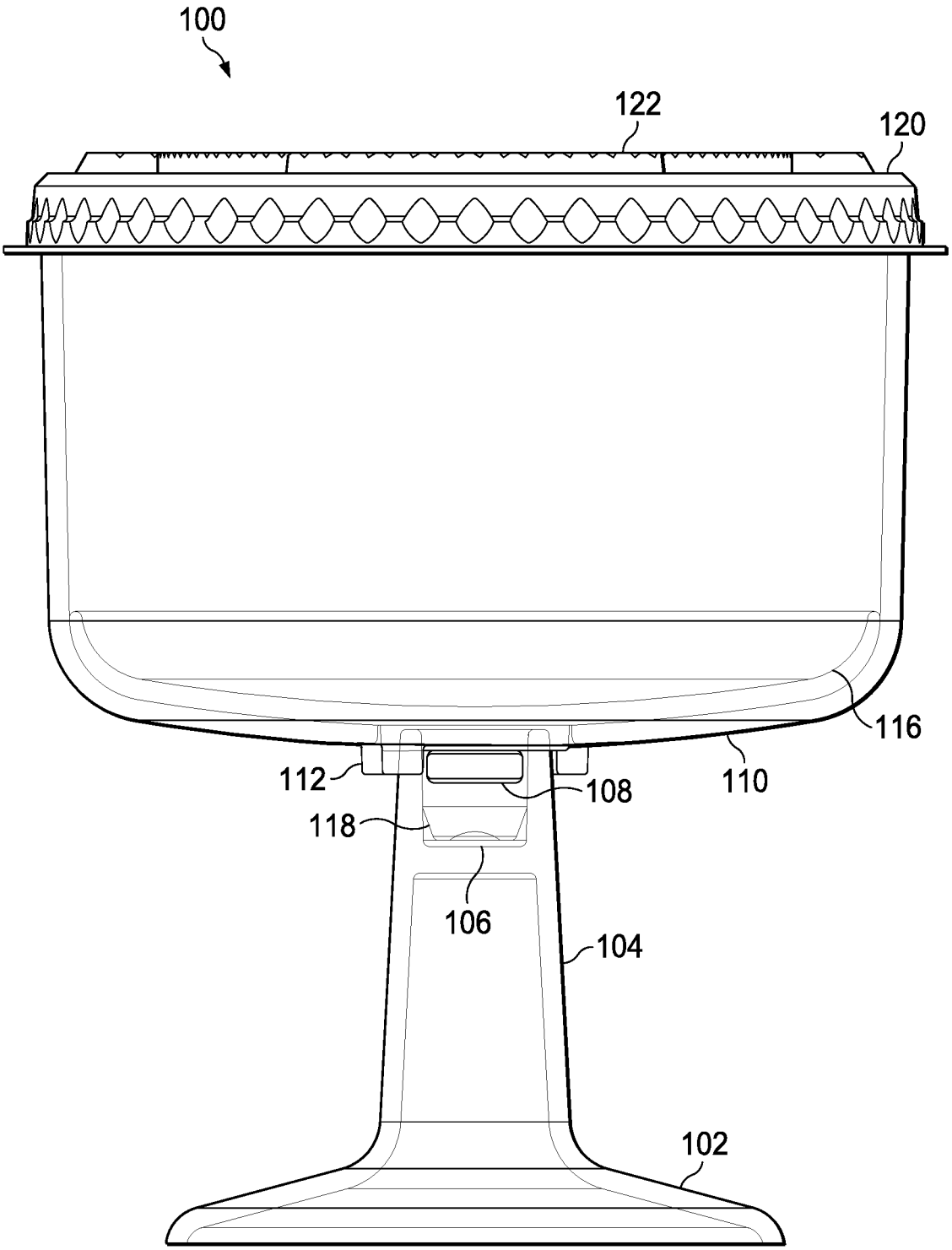
FIG. 1B illustrates a front view of an apparatus for storing and extracting an edible substance according to embodiments of this disclosure.
Figure 1C:
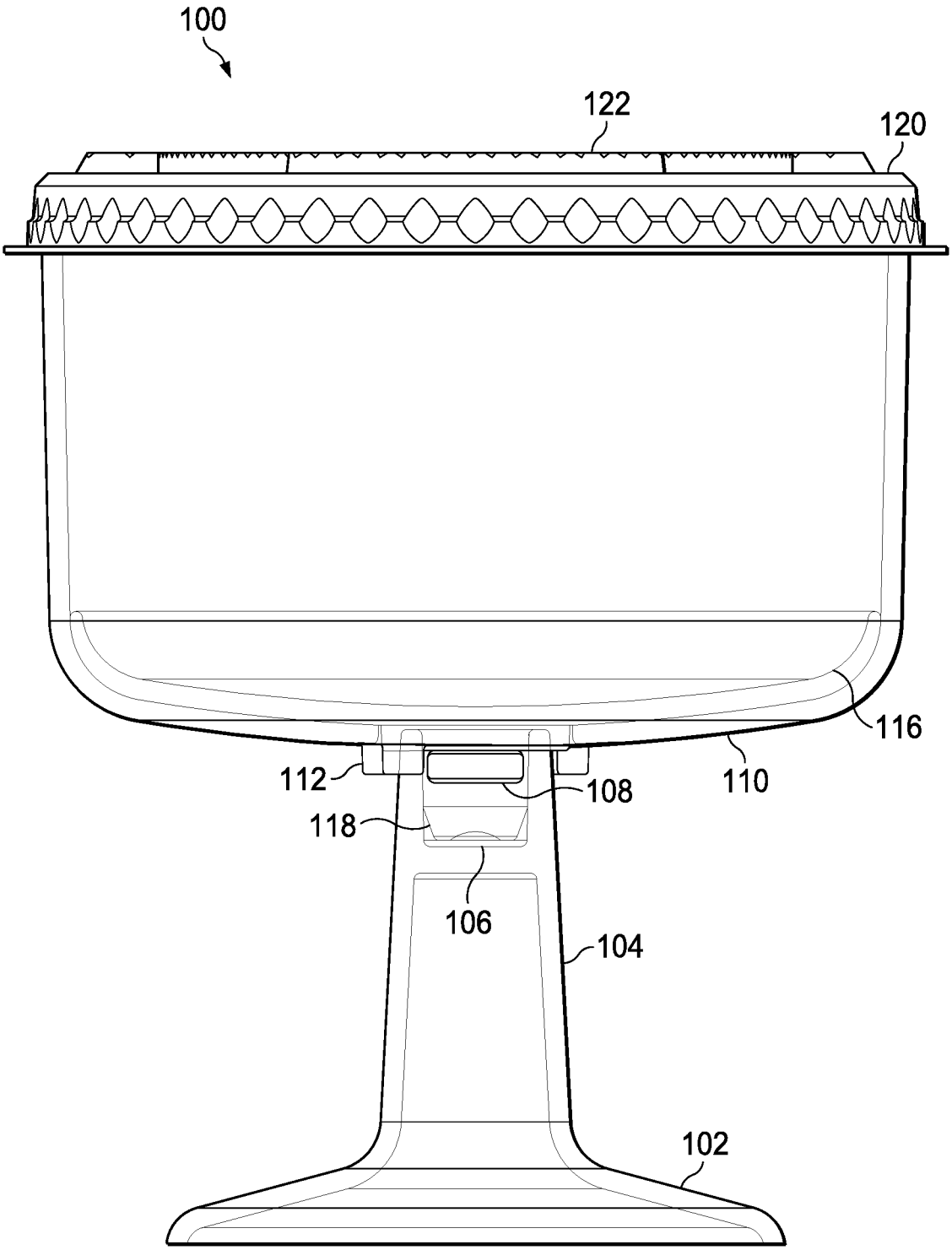
FIG. 1C illustrates a rear view of an apparatus for storing and extracting an edible substance according to embodiments of this disclosure.
Figure 1D:
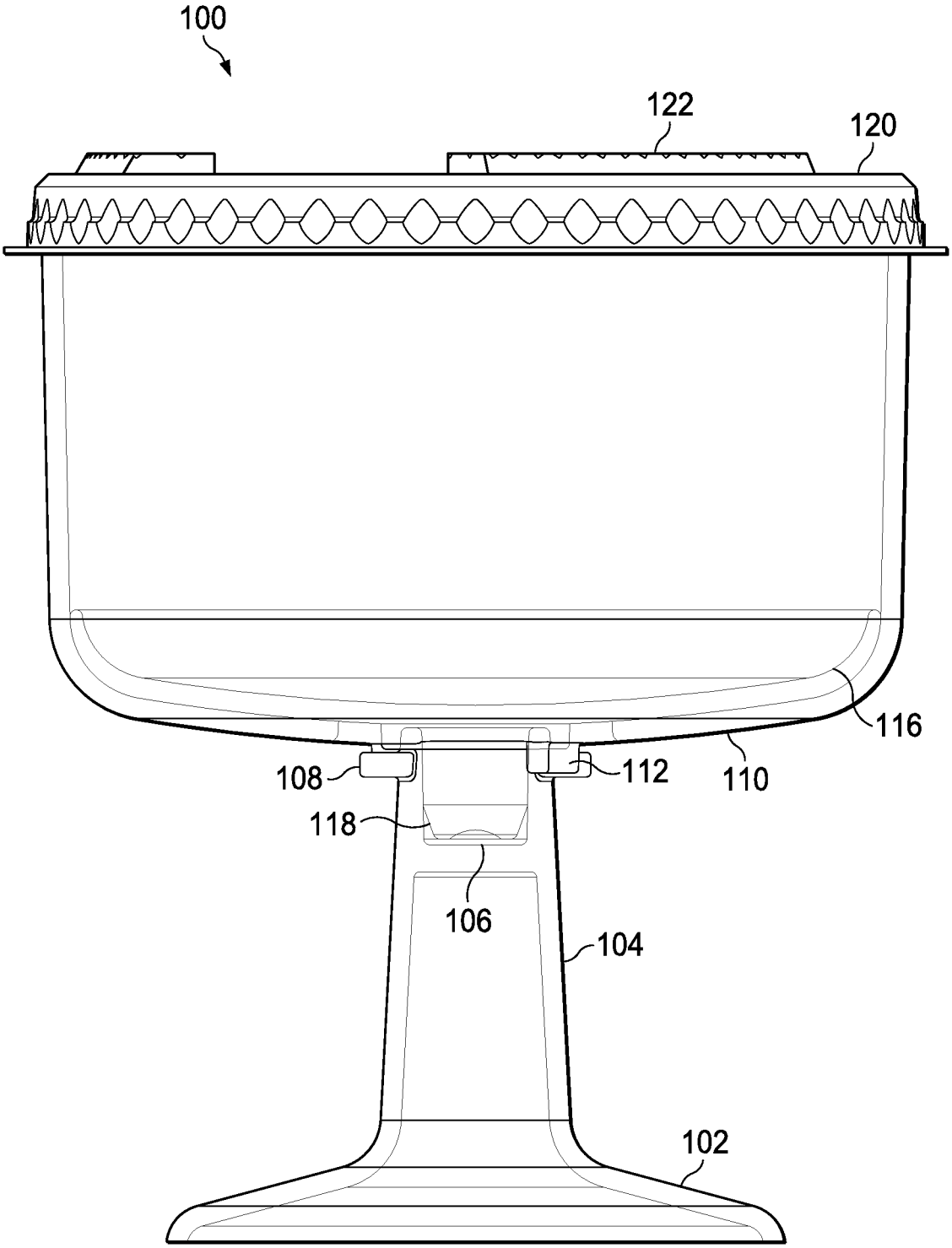
FIG. 1D illustrates a left side view of an apparatus for storing and extracting an edible substance according to embodiments of this disclosure.
Figure 1E:
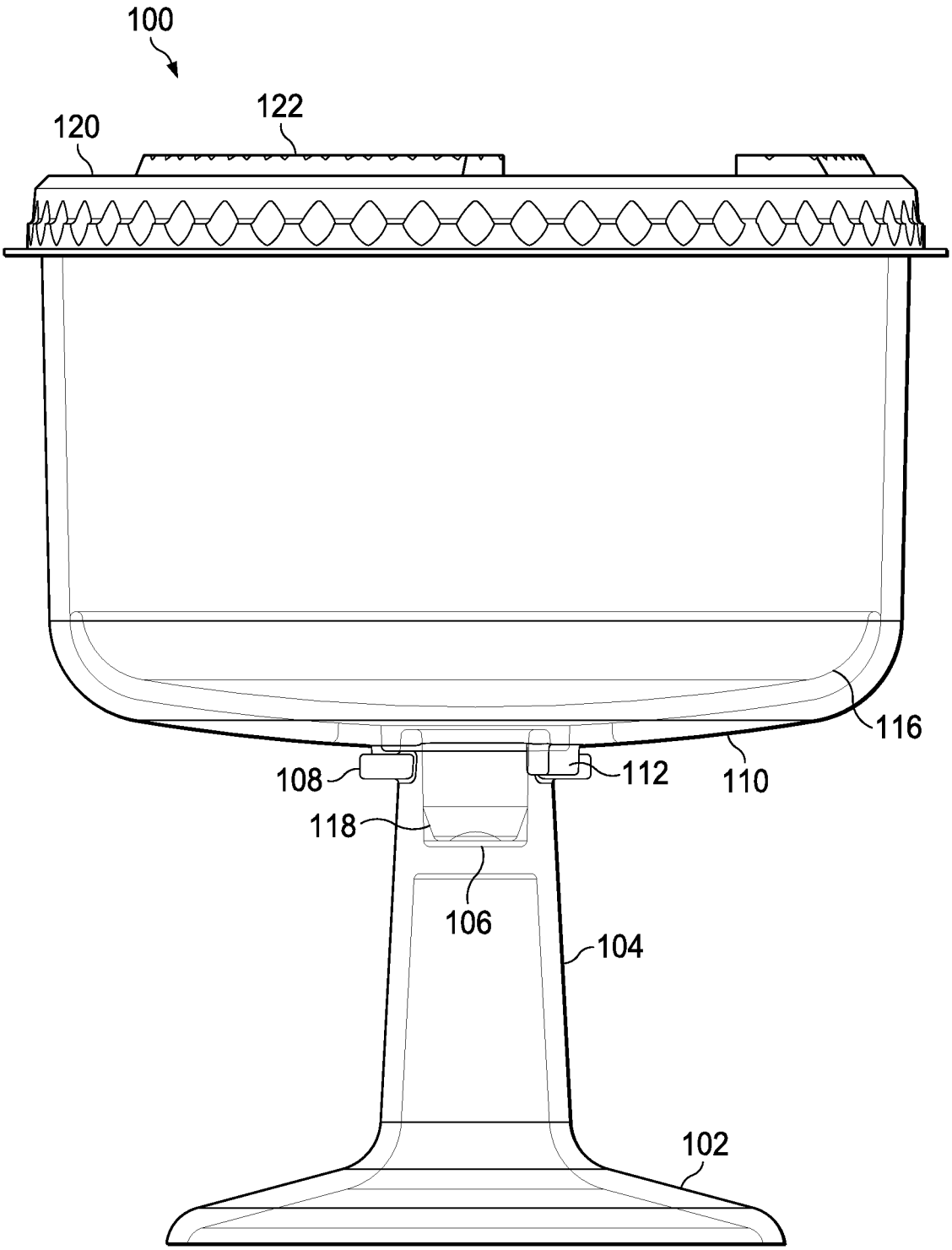
FIG. 1E illustrates a right side view of an apparatus for storing and extracting an edible substance according to embodiments of this disclosure.
Figure 1F:
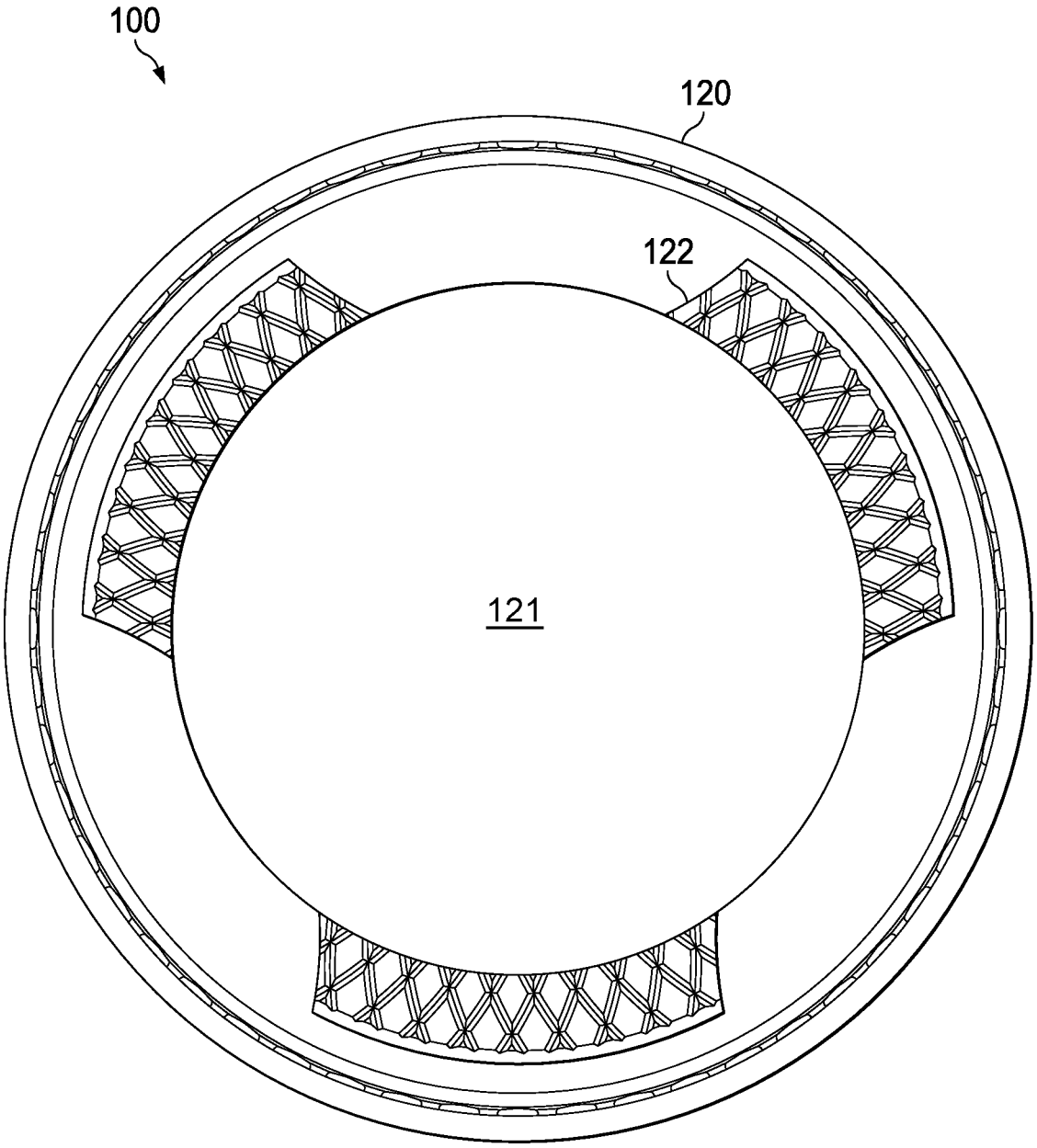
FIG. 1F illustrates a top view of an apparatus for storing and extracting an edible substance in accordance with embodiments of this disclosure.

FIGS. 1A-1F illustrate various views of an apparatus 100 for storing and extracting an edible substance according to various embodiments of this disclosure. FIG. 1A illustrates a perspective view of the apparatus 100, FIG. 1B illustrates a front view of the apparatus 100, FIG. 1C illustrates a rear view of the apparatus 100, FIG. 1D illustrates a left side view of the apparatus 100, FIG. 1E illustrates a right side view of the apparatus 100, and FIG. 1F illustrates a top view of the apparatus 100.

The apparatus 100 for storing and extracting an edible substance includes a base 102, a stem 104, a cavity 106 disposed in the stem 104, one or more protrusions 108 disposed on the stem 104, a container 110, one or more stops 112 disposed on the container, an aperture 114 disposed in a bottom surface of the container 110, a mobile platform 116 including a peg 118, a lid 120, and at least one raised rib 122 disposed on a top surface of the lid 120. The apparatus 100 disclosed can be made from various materials, such as a disposable plastic material, a glass material, a metallic material, or other suitable materials. The base 102 of the apparatus 100 includes a number of features to accommodate the apparatus 100 disclosed herein. The base 102 is circular in shape and is located at a bottom end of the apparatus 100. The stem 104 is of a generally elongated cylindrical shape that extends from a top surface of the base 102 to support the container 110 and the platform 116 at a distance above the base 102. In some embodiments, the base 102 is permanently molded to the stem 104. In some embodiments, the base 102 and the stem 104 comprise a single molded portion of the apparatus 100, and include a hollow center interior portion. In other embodiments, the base may be demountable or detachable from the stem 104. The base 102 of the apparatus 100 supports the stem 104, the platform 116, the container 110, and the lid 120 and allows the apparatus 100 to sit flat on a surface.

In various embodiments, the circular shape of the base 102 can support the weight of multiple apparatuses 100. For example, the at least one raised rib 122 disposed on the top surface of the lid 120 allows for multiple apparatuses to be stacked on top of each other while being stored in a refrigerator or during an event. For example, a base 102 of a first apparatus 100 can be disposed on a center portion 121 of the lid 120 of a second apparatus 100. In some embodiments, the center portion 121 of the lid 120 having substantially the same circumference of the base 102 can be indented or depressed a distance below a perimeter portion of the lid 120 to allow the base 102 of the first apparatus 100 to rest within the indented or depressed area of the center portion 121 of the lid 120. The at least one raised rib 122 can be disposed on the perimeter portion of the lid 120, such that the base 102 resting on the lid 120 contacts the raised rib 122 and is prevented from sliding from the center portion 121 of the lid 120.

In some embodiments, the at least one raised rib 122 includes one rib that extends around the perimeter portion of the lid 120. In some embodiments, the at least one raised rib 122 can include a plurality of raised ribs 122 each extending a distance around the perimeter portion of the lid 120, and that are each spaced from one another at various positions on the lid 120, such as being spaced equidistant from one another, as shown for example in FIGS. 1A and 1F. The stacking function of the apparatus 100 allows the user to easily store the apparatus 100 without having to worry about the edible substance falling out of the container 110 and creating a mess, and allow for multiple apparatuses 100 to be stored or presented at an event in a compact and organized manner. The at least one raised rib 122 also serves as an outer support barrier when a base 102 from one apparatus 100 is placed on top of another apparatus 100. The combination of the lowered portion of the lid 120 and the raised ribs 122 creates a stable structure when storing multiple apparatuses or displaying multiple apparatuses during an event before consumption by the user. In some embodiments, the base 102 can be a different shape, such as a square platform, that is able to support the stem 104, platform 116, container 110, and lid 120 while storing an edible substance. In other embodiments, if the shape of the base 102 is changed, the shape of the lid 120 may also be changed to allow stability when stacking multiple apparatuses 100.

The stem 104 of the apparatus 100 includes the cavity 106 disposed at a top or distal end of the stem 104, the distal end being disposed opposite a proximal end near the base 102. The cavity 106 creates a drum-like or hollow structure within the stem 104. The protrusions 108 are also located at, near, or adjacent the top or distal end of the stem 104 and each extend a distance away from the stem 104 in a direction parallel to a top surface of the stem 104. In some embodiments in which the apparatus 100 includes more than one protrusion 108, the protrusions 108 can be spaced in certain arrangements around the stem 104. For example, if the apparatus 100 includes two protrusions 108, the two protrusions 108 can be positioned on opposite sides of the stem 104, as shown in FIGS. 1A-1E. The peg 118 of the platform 116 extends from a bottom surface of the platform 116. During assembly of the apparatus 100, the platform 116 is inserted within an interior hollow portion of the container 110 defined by an elongated cylindrical wall of the container 110. When inserted into the container 110, the platform 116 is be maintained in a first position in which a bottom surface of the platform 116 rests on or near the bottom surface of the container 110, and such that peg 118 of the platform 116 can extend through the aperture 114 of the bottom surface of the container 110.

The cavity 106 of the stem 104 is operable to receive the peg 118 of the platform 116. When the platform 116 is inserted into the container 110, and the peg 118 is extended through the aperture 114 of the container 110, the stem 104 can be coupled to the platform 116 by inserting the peg 118 into the cavity 106 of the stem 104, such that base 102, stem 104, platform 116, and container 110 are coupled together. Once assembled in this manner, the apparatus 100 is capable of standing on a surface, supported by the base 102, and can receive an edible substance within the container 110, such that the edible substance is disposed or resides on a top surface of the platform 116, where the top surface of the platform 116 is disposed opposite the bottom surface of the container 110 that includes the aperture 114.

In some embodiments, one or more sides of the top surface of the platform 116 can include rounded edges or raised edges that assist with preventing the edible substance from sliding off the platform 116. The rounded edges around the circumference of the platform 116 allow for the platform 116 to move freely within the container 110 and assist in extracting the edible substance being stored in the container 110. In some embodiments, the platform may be molded with the stem. The container 110 of the apparatus 100 can be cylindrical in shape, hollow, include an open top, and the aperture 114 can be in a center of the bottom surface of the container 110. In other embodiments, the container 110 can be a different shape that is able to store an edible substance. The container 110 stores the platform 116 at the first lowered position with the edible substance on top of the platform 116 before the edible substance is extracted for consumption.

When the apparatus 100 is assembled, and optionally when an edible substance is disposed on the platform 116, the lid 120 can then be coupled to a top rim of the container 110 to enclose the edible substance within the container 110, and allow for stacking of another apparatus 100 on the lid 120. The lid 120, when pressed in a downward motion on top of the container 110, also serves as a seal for the edible substance, preventing the edible substance from being contaminated by external factors. In some embodiments, the lid can be further fixed or sealed on the container 110 by using tape, plastic wrap, or other sealing methods.

The lid 120 allows the user to easily transport the edible substance without worrying about spilling the edible substance and creating a mess. To extract the edible substance from the container 110, the user of the apparatus 100 removes the lid 120 and pushes the stem 104 up through the aperture 114 of the container 110 to move the platform 116 from the first position through the interior hollow portion of the container 110 to a second position. In some embodiments, when in the second position, the top surface of the platform 116 is positioned level with or a short distance below a top rim of the container 110, to allow a user to consume the edible substance from the platform 116 without reaching into the container 110 to contact the edible substance. The edible substance stored on the platform 116 can be extracted from the container 110 without the use of one's fingers, tongue, or utensils.

In some embodiments, when the apparatus 100 is assembled such that the peg 118 is inserted through the aperture 114 of the container 110, and the peg 118 is received into the cavity 106 of the stem 104, a locking mechanism can prevent the stem 104 from being pushed through the aperture 114 when the apparatus 100 is placed onto or is standing on a surface, or from being unintentionally pushed through the aperture 114 during handling by a user. When the apparatus 100 is assembled, the protrusions 108 at the top or distal portion of the stem 104 are disposed near, contacting, or adjacent to an underside of the bottom surface of the container 110. The protrusions 108 extend a distance from the stem 104 such that, when in a locked state, the protrusions 108 extend beneath the aperture 114 and beyond a perimeter of the aperture 114, preventing the stem 104 from being pushed through the aperture 114 due to the protrusions coming into contact with the underside of the bottom surface of the container 110. To allow for transition to the unlocked state and allow for the stem 104 to be pushed through the aperture 114 of the container 110, the aperture 114 can be in a circular shape with additional cutouts 115 at certain points along the circumference of the circular shape of the aperture 114 that match the number and shape of the protrusions 108 of the stem 104, such that, when turned to the proper alignment, the protrusions 108 can be pushed though the cutouts 115.

The locking mechanism can further include one or more stops 112 disposed on the bottom surface of the container 110. A number of the one or more stops 112 on the bottom surface of the container 110 can match the number of protrusions 108 on the stem 104, and can be disposed adjacent the cutouts 115 of the aperture 114. When the platform 116 is in the first position, the stem 104 and the protrusions 108 can be rotated below the aperture 114 and in a direction away from the cutouts 115 and towards the stops 112, such that the protrusions 108, contacting the underside of the bottom surface of the container 110, come into contact with the stops 112, preventing further rotation and positioning the protrusions perpendicular to the cutouts 115 of the aperture 114. The protrusions 108 thus prevent the stem 104 and the platform 116 from being moved from the first position when in the locked state.

The placement of the stops 112 adjacent the cutouts 115 prevents the turning of the stem 104 beyond a certain point, at which point the protrusions 108 come into contact with the stops 112, preventing further rotation. When the protrusions 108 are in contact with the stops 112, the apparatus 100 is in a locked state in which the stem 104 and the platform 116 cannot be pushed through the aperture 114 of the container 110. The stem 104 can be rotated such that the protrusions 108 are also rotated to a position in which the protrusions are aligned with the cutouts 115 of the aperture 114, such that the apparatus 10 is in an unlocked, allowing the upward movement of the base 102, stem 104, and platform 116 from the first position to the second position, and to allow extraction of the edible substance from the container 110. In some embodiments, the stops 112 also serve as stoppers when the base 102 and stem 104 move to the second position to allow extraction of the edible substance, by the stops 112 contacting a bottom portion of the stem 104 or a top portion of the base 102, to prevent further vertical movement of the platform 116, while also preventing the platform 116 from being ejected from the container 110.

In some embodiments, the stem 104 can be attached to the platform using various fastening mechanisms or be molded permanently to the platform. In some embodiments, there may be no protrusions 108 from the stem 104 and/or no stops 112. For example, if the apparatus 100 does not include the stops 112, but includes the protrusions 108, the apparatus 100 can still be moved to the locked position by rotating the stem 104 such that the protrusions 108 are positioned perpendicular to the cutouts 115 of the aperture 114. As another example, if the apparatus 100 does not include both the stops 112 and the protrusions 108, an edible substance can be used with the apparatus 100 that is heavy enough to keep the stem 104 pushed down, even when the base 102 of the apparatus 100 is standing on a surface. In embodiments that do not include the protrusions 108, the aperture 114 can also not include the cutouts 115, such that the aperture 114 is a circular shape without cutouts, for example. This allows for the stem 104 to still be pushed through the aperture 114 to move the platform 116 from the first position to the second position.

Figure 2:
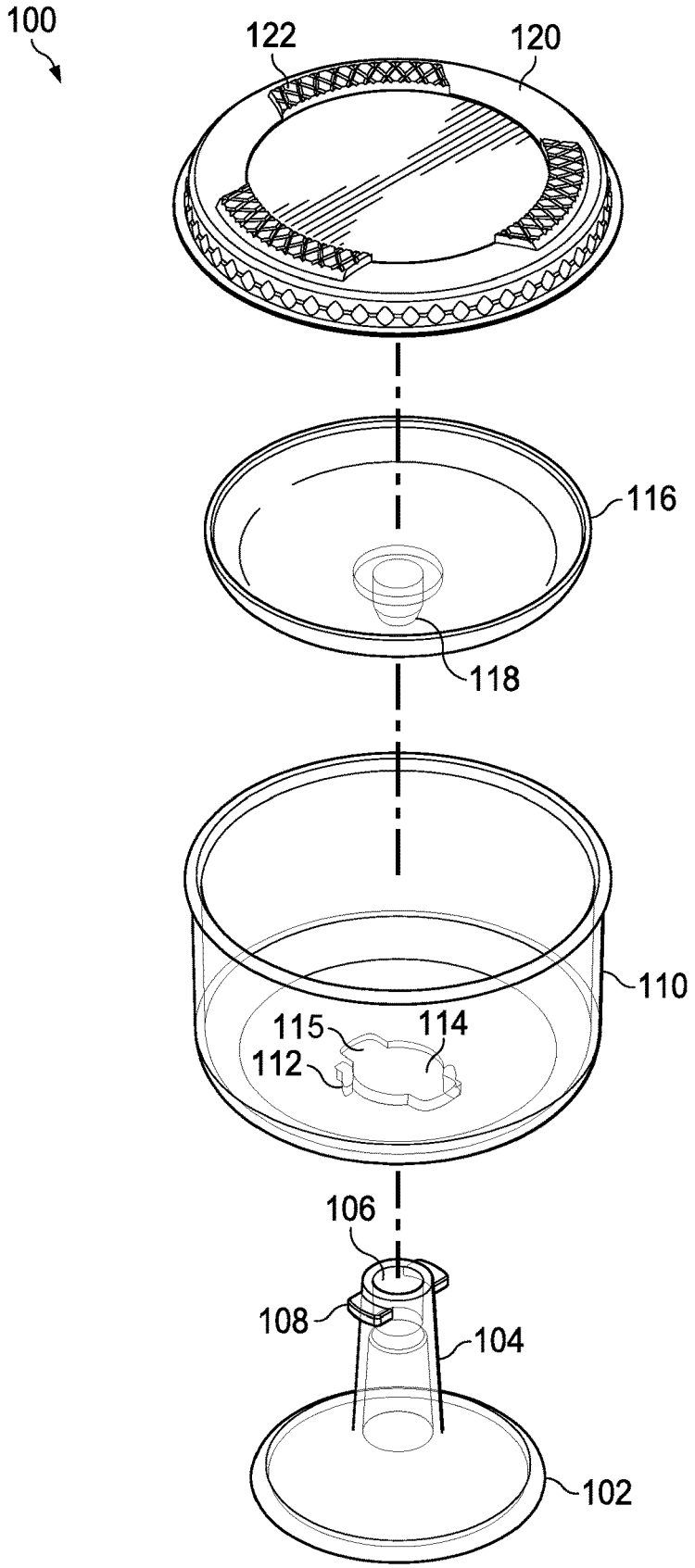
FIG. 2 illustrates an exploded view of an apparatus for storing and extracting an edible substance in accordance with embodiments of this disclosure.

FIG. 2 illustrates an exploded view of the apparatus 100 for storing and extracting an edible substance in accordance with various embodiments of this disclosure. Specifically, FIG. 2 shows that the platform 116 is inserted into the container 110 such that the peg 118 is inserted through the aperture 114 and the platform 116 rests on the bottom surface of the container 110. The lid 120 seals the container 110 when the platform 116 is inside the container 110 and at the lowered first position. FIG. 2 also shows that the container 110 is aligned with the stem 104 so that the protrusions 108 from the stem 104 are adjacent to the stops 112 on the container 110 in the locked state. The peg 118 of the platform 116 is placed or inserted in the cavity 106 of the stem 104, coupling the platform 116 to the stem 104. Assembling the apparatus 100 as illustrated in FIG. 2, and as otherwise described is this disclosure, allows for proper storage of the edible contents in the container 110 and allows for extracting the edible substance by pushing the stem 104 through the aperture 114 to move the platform 116 in an upwards direction through the interior of the container 110 from the first lowered position in which the platform 116 rests on the bottom surface of the container 110 to the second raised position in which the platform is moved close to a top or the rim of the container 110 to position the edible substance disposed on the platform 116 at or above the rim of the container 110.

Figure 3A:
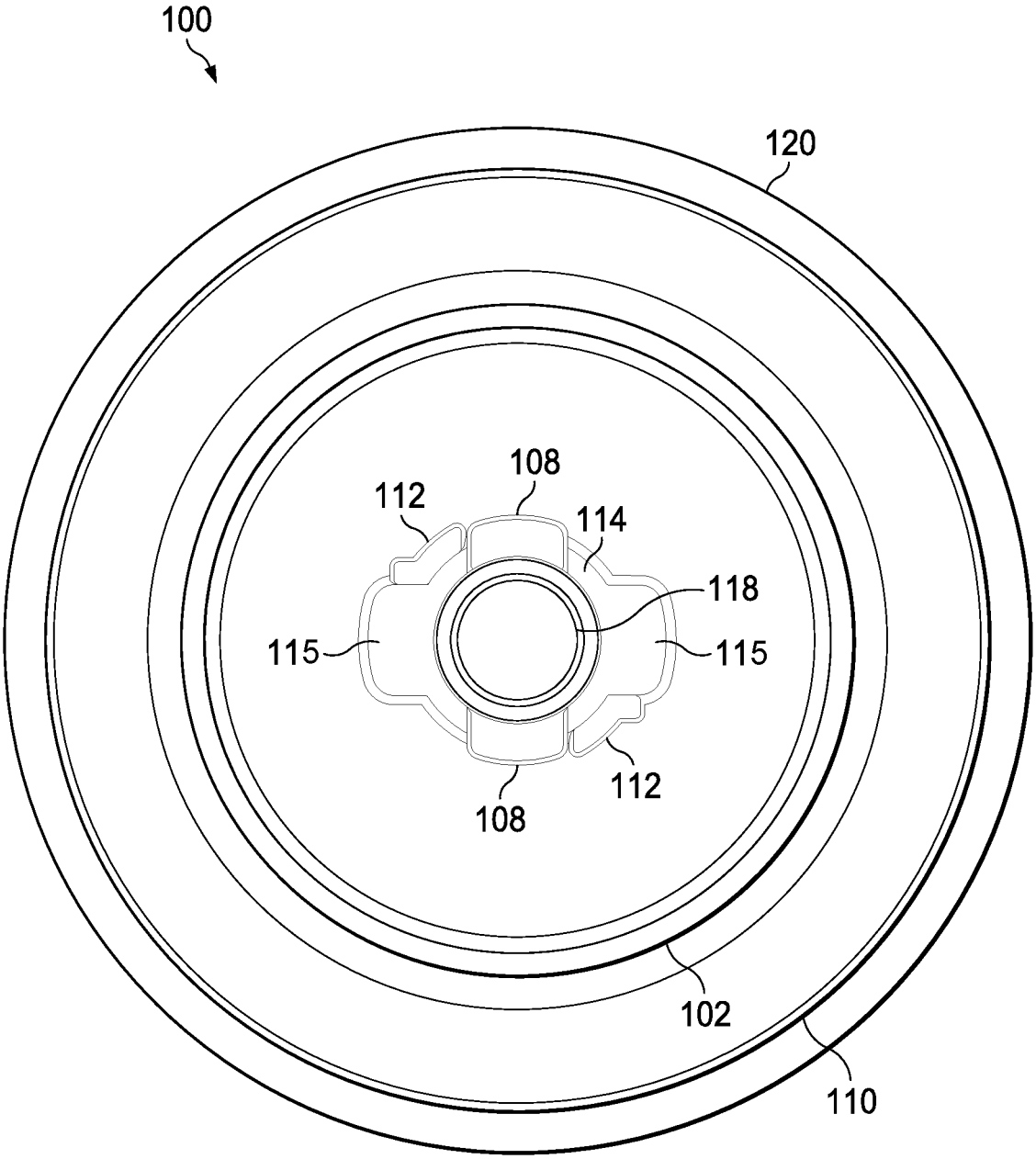
FIG. 3A illustrates a bottom view of an apparatus for storing and extracting an edible substance in a locked state in accordance with embodiments of this disclosure.
Figure 3B:
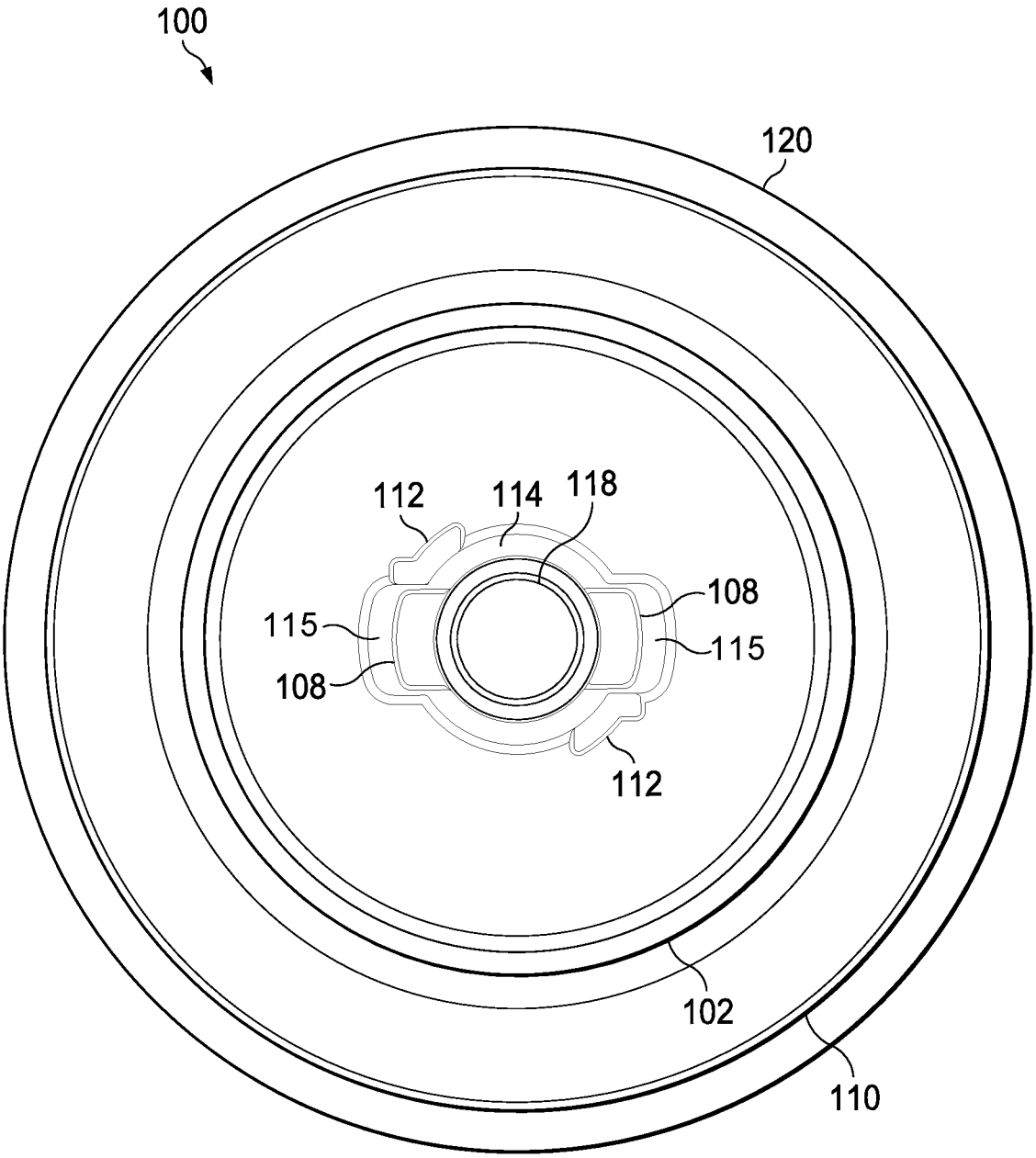
FIG. 3B illustrates a bottom view of an apparatus for storing and extracting an edible substance in an unlocked state in accordance with embodiments of this disclosure.
Figure 3C:
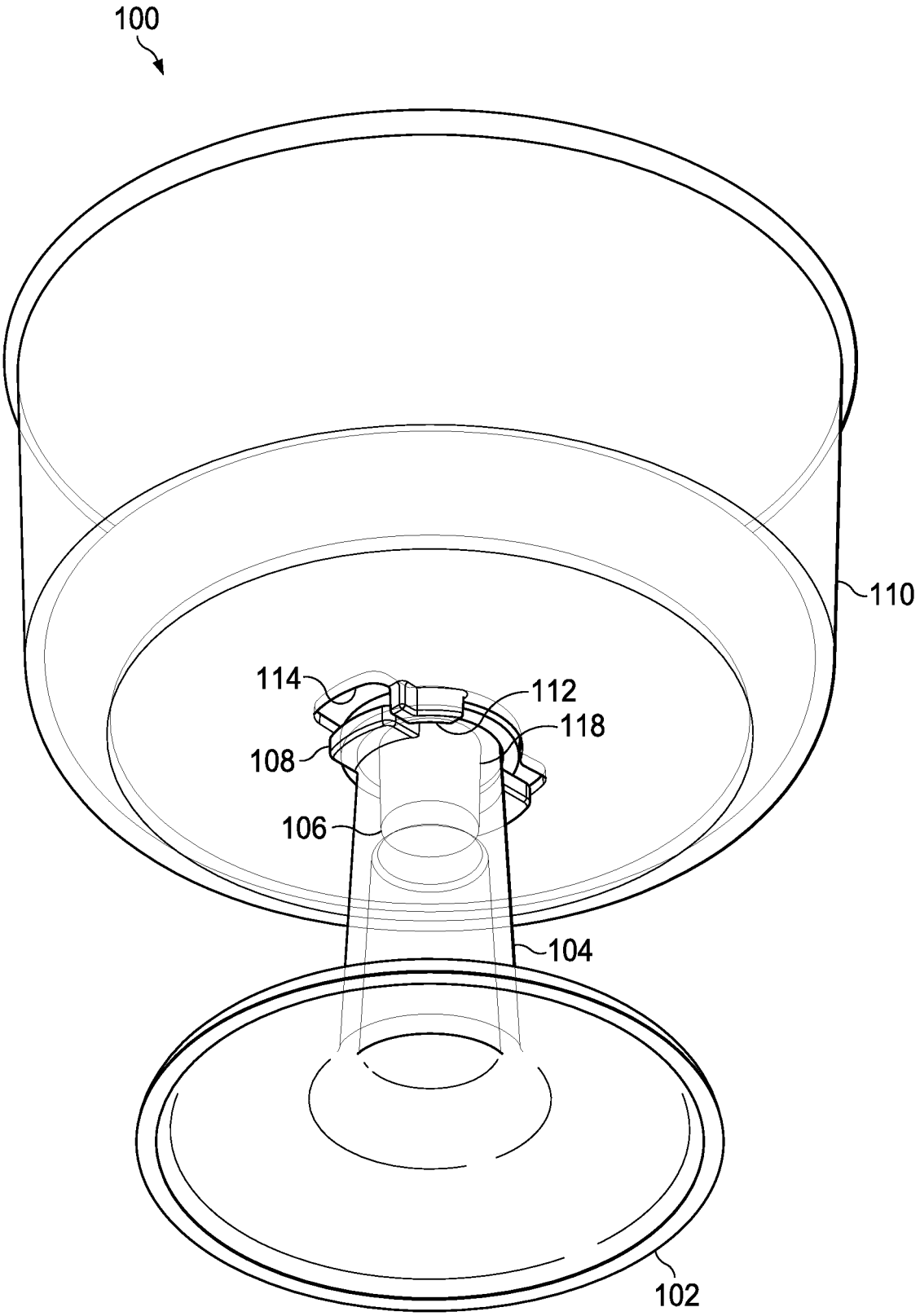
FIG. 3C illustrates a perspective view of an apparatus for storing and extracting an edible substance in an unlocked state in accordance with embodiments of this disclosure.
Figure 3D:
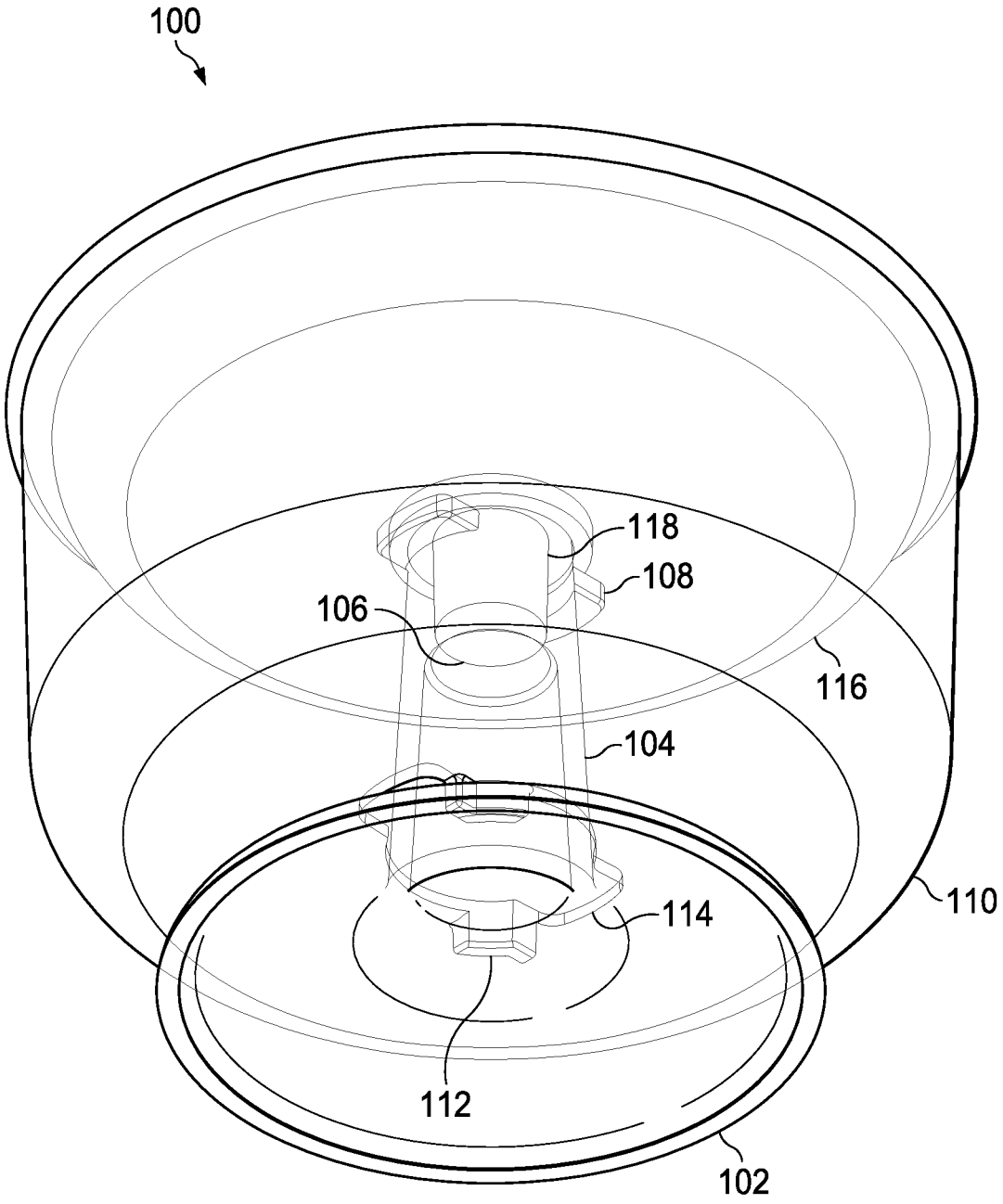
FIG. 3D illustrates a perspective view of an apparatus for storing and extracting an edible substance with a raised platform in accordance with embodiments of this disclosure.

FIGS. 3A-3D illustrate various views of the apparatus 100 according to various embodiments of this disclosure. FIG. 3A illustrates a bottom view of the assembled container 110, platform 116, base 102, and stem 104 in the locked state in accordance with various embodiments of this disclosure. FIG. 3B illustrates a bottom view of the assembled container 110, platform 116, base 102, and stem 104 in the unlocked state in accordance with various embodiments of this disclosure. FIG. 3C illustrates a perspective view of the assembled container 110, platform 116, base 102, and stem 104 in the unlocked state and the platform is in the first lowered position in accordance with embodiments of the present disclosure. FIG. 3D illustrates a perspective view of the assembled container 110, platform 116, base 102, and stem 104 in which the platform 116 is in the second raised position.

FIGS. 3A-3D illustrate the steps of extracting the edible substance from the container 110. As shown in FIG. 3A, the apparatus 100 is first in a locked state in which the apparatus 100 is assembled such that the platform 116 rests on the bottom interior surface of the container 110, the peg 118 of the platform 116 is inserted through the aperture 114 and into the cavity 106 of the stem 104, and the protrusions 108 are positioned to be adjacent the stops 112 on the underside of the bottom surface of the container 110, as also described with respect to FIGS. 1A-1F and FIG. 2.

To use the apparatus 100 to extract an edible substance after removing the lid 120, the user rotates the stem 104 from the locked state, as shown in FIG. 3A, to the unlocked state in which the protrusions 108 are aligned with the cutouts 115 of the aperture 114 in the bottom surface of the container 110, as shown in FIGS. 3B and 3C. Aligning the protrusions 108 in the manner illustrated in FIGS. 3B and 3C allows the user to push the base 102 or the stem 104 in an upward motion, resulting in the platform 116, coupled to the stem 104 via the peg 118 being inserted into the cavity 106, rising towards and to the second position at the top of the container 110, as illustrated in FIG. 3D. When the platform 116 is near to or reaches the top of the container 110, the platform 116 supports the edible substance outside of the container 110 at or above the rim of the container 110, allowing for the easy, clean, and sanitary consumption of the edible substance without the user needing his or her finger, tongue, or utensils to extract the edible substance.

After consuming the edible substance, the user can safely discard or return the apparatus 100. In some embodiments, prior to discarding or returning the apparatus 100, a user can reverse the process of using the apparatus 100 by pulling the stem 104 back through the aperture 114 until the protrusions 108 exit the interior of the container 110, rotating the stem 104 back to the locked position such that the protrusions 108 contact the stops 112, and reattaching the lid 120 around the rim of the container 110. Reversing the process of using the apparatus 100 and reattaching the lid 120 can provide for more sanitary disposal or handling of the apparatus 100, since during consumption of the edible substance from the platform 116 in the second position the user's mouth can come into contact with the rim of the container 110 and/or the platform 116, both of which are then covered by reattaching the lid 120.

Figure 4:
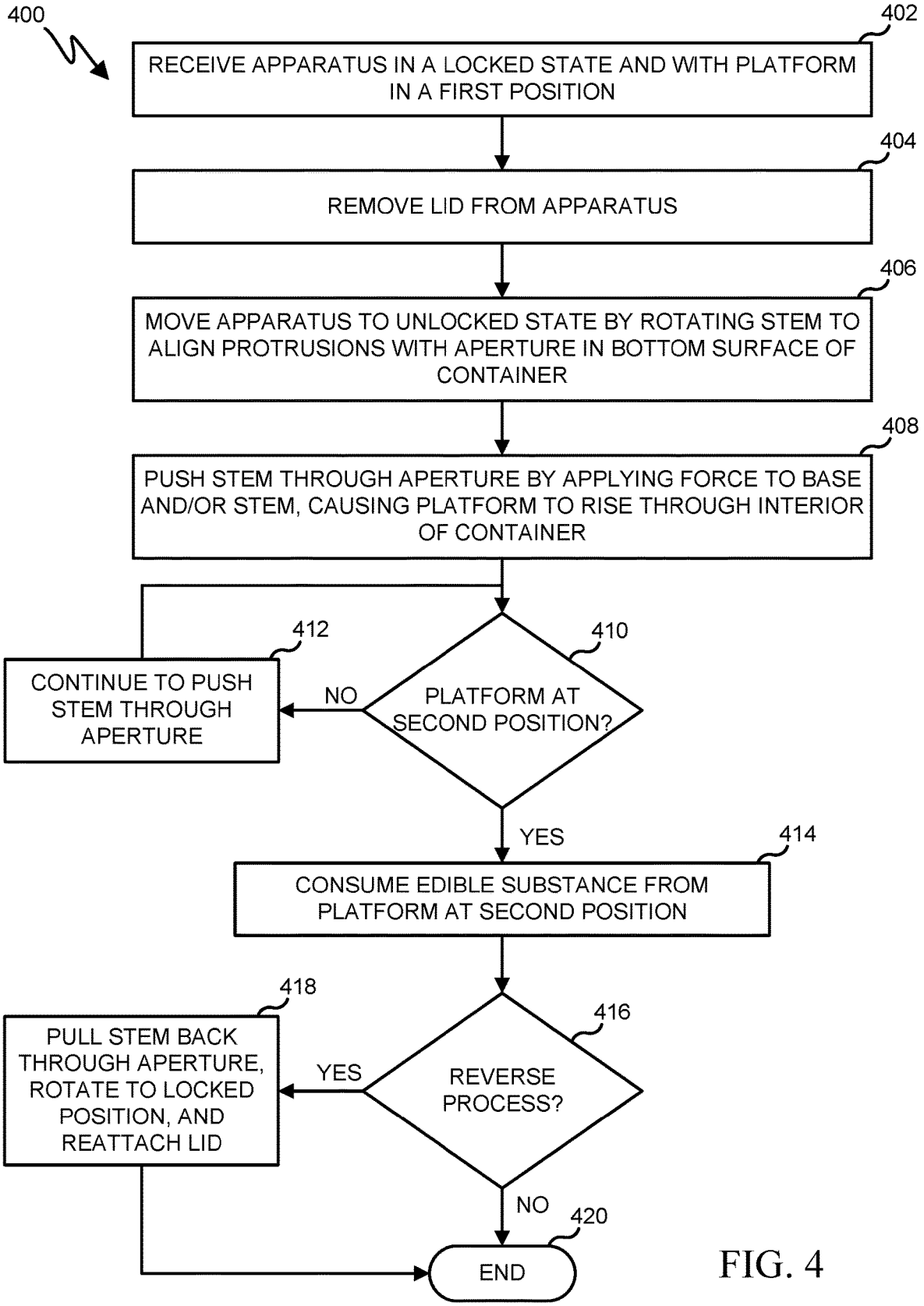
FIG. 4 illustrates a flowchart of an edible substance extraction process in accordance with various embodiments of this disclosure.

FIG. 4 illustrates a flowchart of an edible substance extraction process 400 in accordance with various embodiments of this disclosure. FIG. 4 does not limit the scope of this disclosure to any particular embodiments. While the flowchart depicts a series of sequential steps, unless explicitly stated, no inference should be drawn from that sequence regarding specific order of performance, performance of steps or portions thereof serially rather than concurrently or in an overlapping manner, or performance of the steps depicted exclusively without the occurrence of intervening or intermediate steps. The process 400 can be used with the apparatus 100 described herein, but can also be used with any similar apparatus.

At block 402, the user receives an assembled apparatus 100 in a locked state, with the protrusions 108 on the stem 104 adjacent to the stops 112 on the container 110, such as shown in FIG. 3A. The received apparatus 100 can include an edible substance disposed in within the container 110 and on the platform 116. When a user wishes to consume the edible substance, at block 404, the user removes the lid 120 from the apparatus 100. At block 406, the user rotates the stem 104 until the protrusions 108 are aligned with the aperture 114, such as by aligning the protrusions 108 with cutouts 115 in the aperture 114. Once aligned, the protrusions 108 can be lifted or pushed through the aperture 114. At block 408, the user begins pushing the protrusions 108 and the stem 104 through the aperture 114 by applying enough upward pressure to the base 102 and/or the stem 104, to begin lifting the platform 116 though the container 110.

In some embodiments, there may be no protrusions 108 from the stem 104 and/or no stops 112. For example, if the apparatus 100 does not include the stops 112, but includes the protrusions 108, the apparatus 100 can still be moved to the locked position by rotating the stem 104 such that the protrusions 108 are positioned perpendicular to the cutouts 115 of the aperture 114. As another example, if the apparatus 100 does not include both the stops 112 and the protrusions 108, an edible substance can be used with the apparatus 100 that is heavy enough to keep the stem 104 pushed down, even when the base 102 of the apparatus 100 is standing on a surface. In embodiments that do not include the protrusions 108, the aperture 114 can also not include the cutouts 115, such that the aperture 114 is a circular shape without cutouts, for example. This allows for the stem 104 to still be pushed through the aperture 114 to move the platform 116 from the first position to the second position.

At decision block 410, it is determined whether the platform 116 has reached the highest position, or the second position as described with respect to the various embodiments of this disclosure. In some embodiments, the second position can be reached once the stops 112 on the bottom surface of the container 110 contact a portion of the stem 104 or the base 102, preventing further upwards movement of the base 102, stem 104, and platform 116. In some embodiments, the apparatus 100 may not include stops 112, and the second position is reached when the stem 104 and/or base 102 contact an underside of the bottom surface of the container 110, or when the shape of the stem 104 causes the stem 104 to contact sides of the aperture 114, restricting further movement of the base 102 and stem 104 due to the contact between the stem 104 and the sides of the aperture 114. If, at decision block 410, it is determined that the platform 116 has not reached the second position, at block 412, the user continues to push the stem 104 through the aperture 114. The process 400 then loops back to decision block 410. When the platform 116 reaches the second position, the edible substance will have been extracted from the container 110 and will rest on the platform 116 outside of or above the container 110, such that at least a portion of the edible substance is disposed above the top rim of the container 110. Once, at decision block 410, the platform has reached the second position, the process 400 moves to block 414. At block 414, the user can consume the edible substance from the raised platform 116 without having to use any other means of extracting the edible substance from the container 110.

After consuming the edible substance, the user can safely discard or return the apparatus 100. In some embodiments, prior to discarding or returning the apparatus 100, a user, at decision block 416, can decide to reverse the extraction process to return the apparatus 100 back to its received configuration as in block 402. If the extraction process is not reversed, the process 400 ends at block 420. If the extraction process is reversed, at block 418 the user reverses the extraction process by pulling the stem 104 back through the aperture 114 until the protrusions 108 exit the interior of the container 110, rotating the stem 104 back to the locked position such that the protrusions 108 contact the stops 112, and reattaching the lid 120 around the rim of the container 110. Reversing the process of using the apparatus 100 and reattaching the lid 120 can provide for more sanitary disposal or handling of the apparatus 100, since during consumption of the edible substance from the platform 116 in the second position the user's mouth can come into contact with the rim of the container 110 and/or the platform 116, both of which are then covered by reattaching the lid 120. The process ends at block 420.

Although FIG. 4 illustrates one example of an edible substance extraction process 400, various changes may be made to FIG. 4. For example, block 404 can occur after one of blocks 406 or 408 if the user wishes to keep the lid 120 on the container 110 until the edible substance nears the top of the container 110. In some embodiments, the user can choose not to consume the edible substance at block 414, and can reverse the process to move the platform 116 back to the first position.

Figure 5:
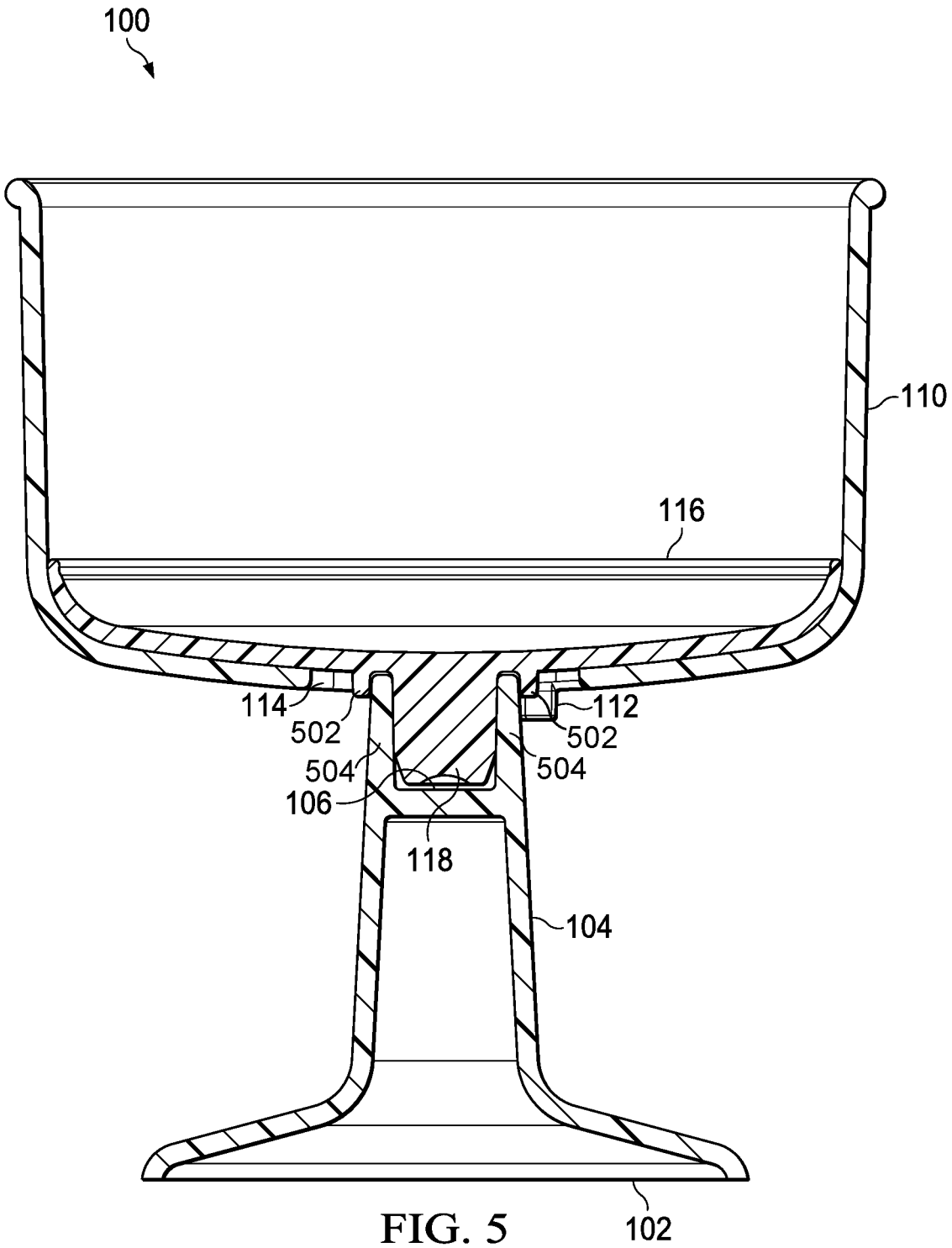
FIG. 5 illustrates a cross section of an apparatus for storing and extracting an edible substance in accordance with various embodiments of this disclosure.

FIG. 5 illustrates a cross section of a side view of an apparatus 100 for storing and extracting an edible substance in accordance with various embodiments of the present disclosure. As shown in FIG. 5, to assemble the apparatus 100, platform 116 is inserted into the container 110, and the peg 118 is inserted and fits within the cavity 106 of the stem 104 until coming close to or contacting a lower inner surface of the cavity 106. In some embodiments, the base 102 and stem 104 can be one component wherein at least a portion of the base 102 and stem 104 includes a hollow interior. In some embodiments, the base 102 and stem 104 is a solid component without having a hollow interior portion. In some embodiments, such as shown in FIG. 5, an underside of the platform 116 adjacent the peg 118 can include notched portions 502 that couple with sides 504 of the cavity 106 of the stem 104, to provide additional structural support and tighter coupling between the platform 116 and the stem 104.

FIG. 5 further illustrates the shape of the container 110. In some embodiments, a top rim of the container 110 can have curved edges that can assist with the coupling of the lid 120 on the container 110. FIG. 5 also illustrates the shape of the platform 116 in some embodiments in which the platform 116 has curved edges that allow for the platform 116 to move through the hollow interior of the container 110 without scraping interior walls of the of the container 110. The curved edges of the platform 116 also prevent the edible substance from slipping or sliding off the platform 116, especially when the platform 116 is moved to the second position.

Figure 6A:
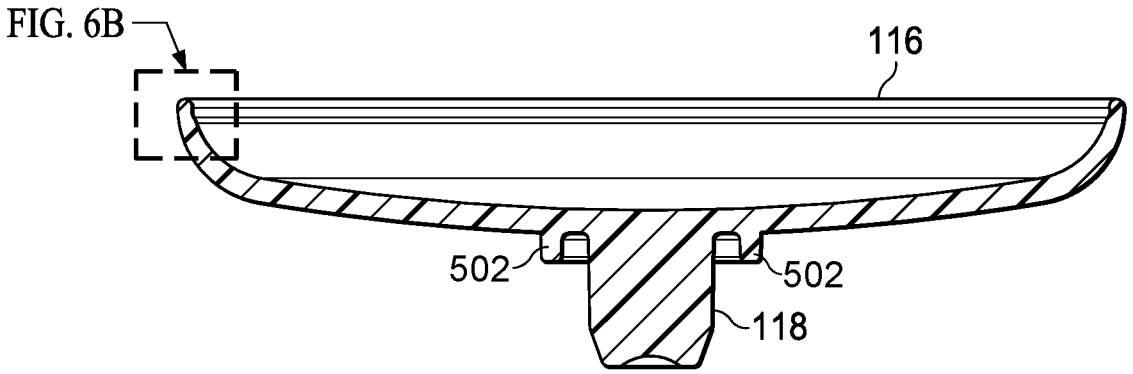
FIG. 6A illustrates a cross section of a platform of an apparatus for storing and extracting an edible substance in accordance with various embodiments of this disclosure.
Figure 6B:
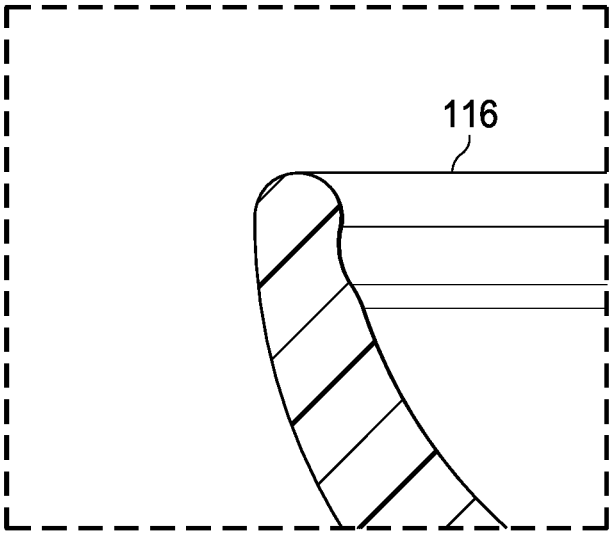
FIG. 6B illustrates an enlarged view of an edge of a platform of an apparatus for storing and extracting an edible substance in accordance with various embodiments of this disclosure.

FIG. 6A illustrates a cross section of the platform 116 and FIG. 6B illustrates am enlarged view of the edge of the platform 116 in accordance with various embodiments of the present disclosure. As shown in FIG. 6A, in some embodiments, the platform 116 includes a generally flat or slightly curved surface that extends into rounded sides or edges. The generally flat or slightly curved surface of the platform 116 supports the edible substance when it is stored and when the edible substance is extracted from the container 110 before consumption. The rounded edges of the platform 116 assist with the extraction of the edible substance being stored, and also assist with preventing the edible substance from sliding or slipping off the platform 116 and falling out of the apparatus 100 when the platform is raised to the second position.

FIG. 6B provides a zoomed in perspective of the rounded edges of the platform 116 that are located around the circumference of the platform 116, which assist in extracting the edible substance from the container 110 and prevent the edible substance from sliding or slipping off the platform 116 when the platform is raised to the second position. In some embodiments, such as also shown in FIG. 5, an underside of the platform 116 adjacent the peg 118 can include the notched portions 502 that couple with the sides 504 of the cavity 106 of the stem 104, to provide additional structural support and tighter coupling between the platform 116 and the stem 104.

Figure 7A:
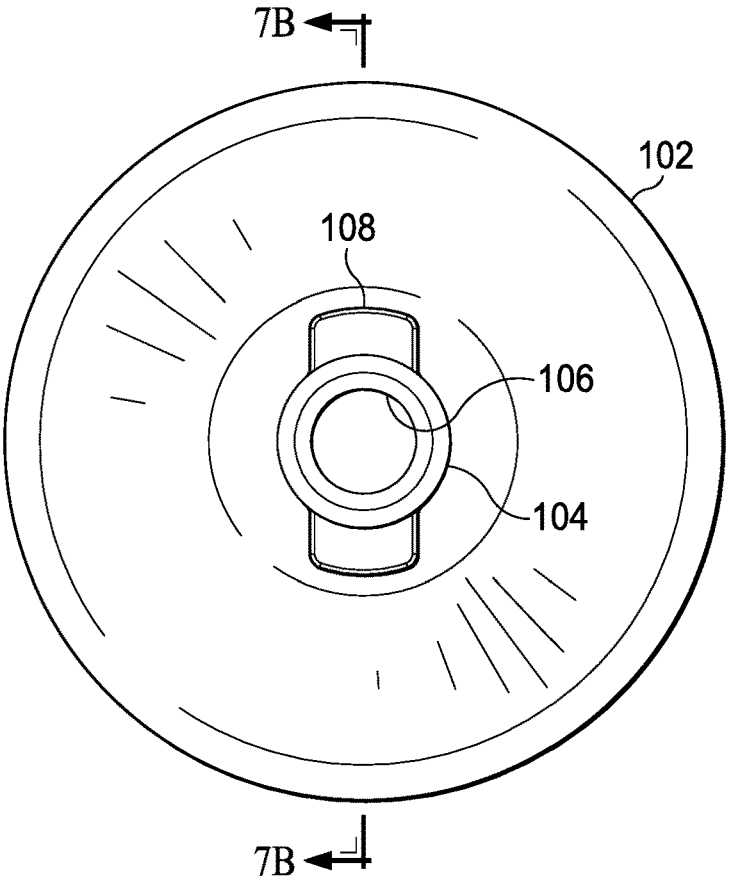
FIG. 7A illustrates a top view of a base and stem of an apparatus for storing and extracting an edible substance in accordance with various embodiments of this disclosure.
Figure 7B:
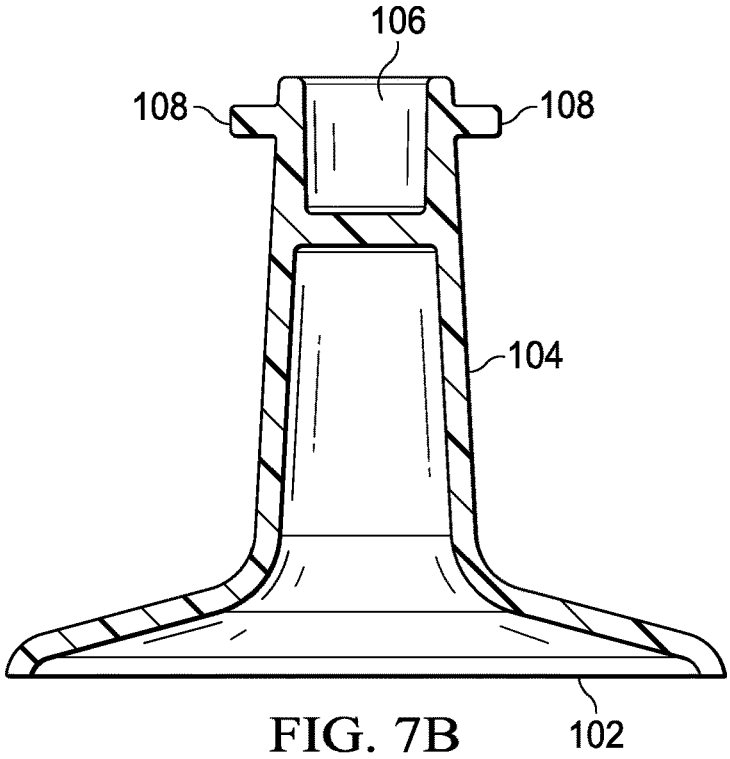
FIG. 7B illustrates a cross section of a base and stem of an apparatus for storing and extracting an edible substance in accordance with various embodiments of this disclosure.

FIG. 7A illustrates a top view of the base 102 and stem 104 and FIG. 7B illustrates a cross section of the base 102 and stem 104 in accordance with the various embodiments of the present disclosure. As shown in FIG. 7A, the two protrusions 108 located at the top of the stem 104 can, in some embodiments, be disposed on opposite sides of the stem 104. FIG. 7A also shows the position of the stem 104 when in the first position before the stem 104 is moved upward and through the aperture 114 to the second position. FIG. 7B illustrates how, in some embodiments, the stem 104 can be molded with the base 102 of the apparatus 100. In some embodiments, the base 102 and the stem 104 can be separate components that can be coupled together, such as if the base 102 includes a cavity for receiving the stem 104 into the cavity of the base 102. FIG. 7B also provides a clear view of the cavity 106 where the peg 118 couples to the stem 104.

Figure 8A:
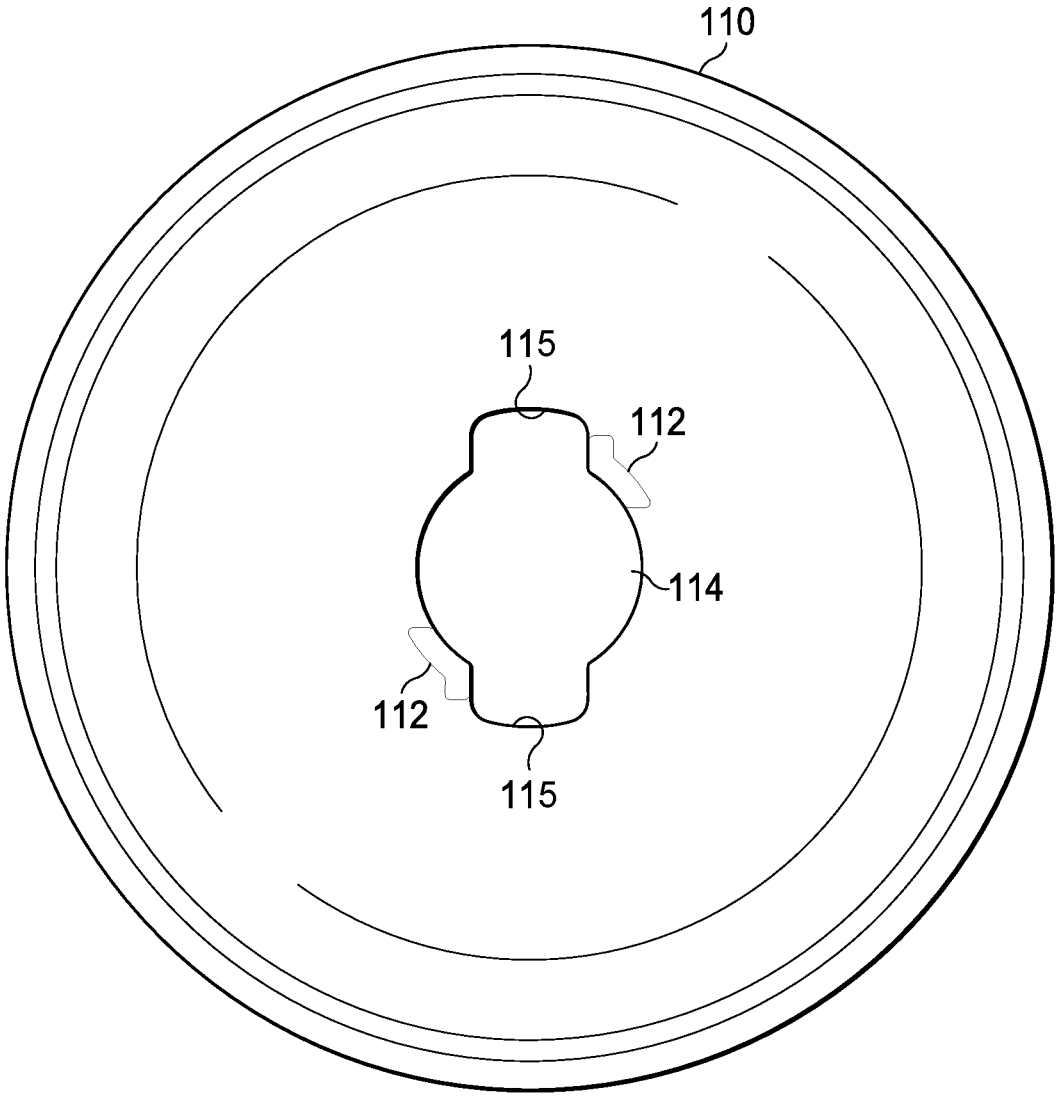
FIG. 8A illustrates a top view of a container of an apparatus for storing and extracting an edible substance in accordance with various embodiments of this disclosure.
Figure 8B:
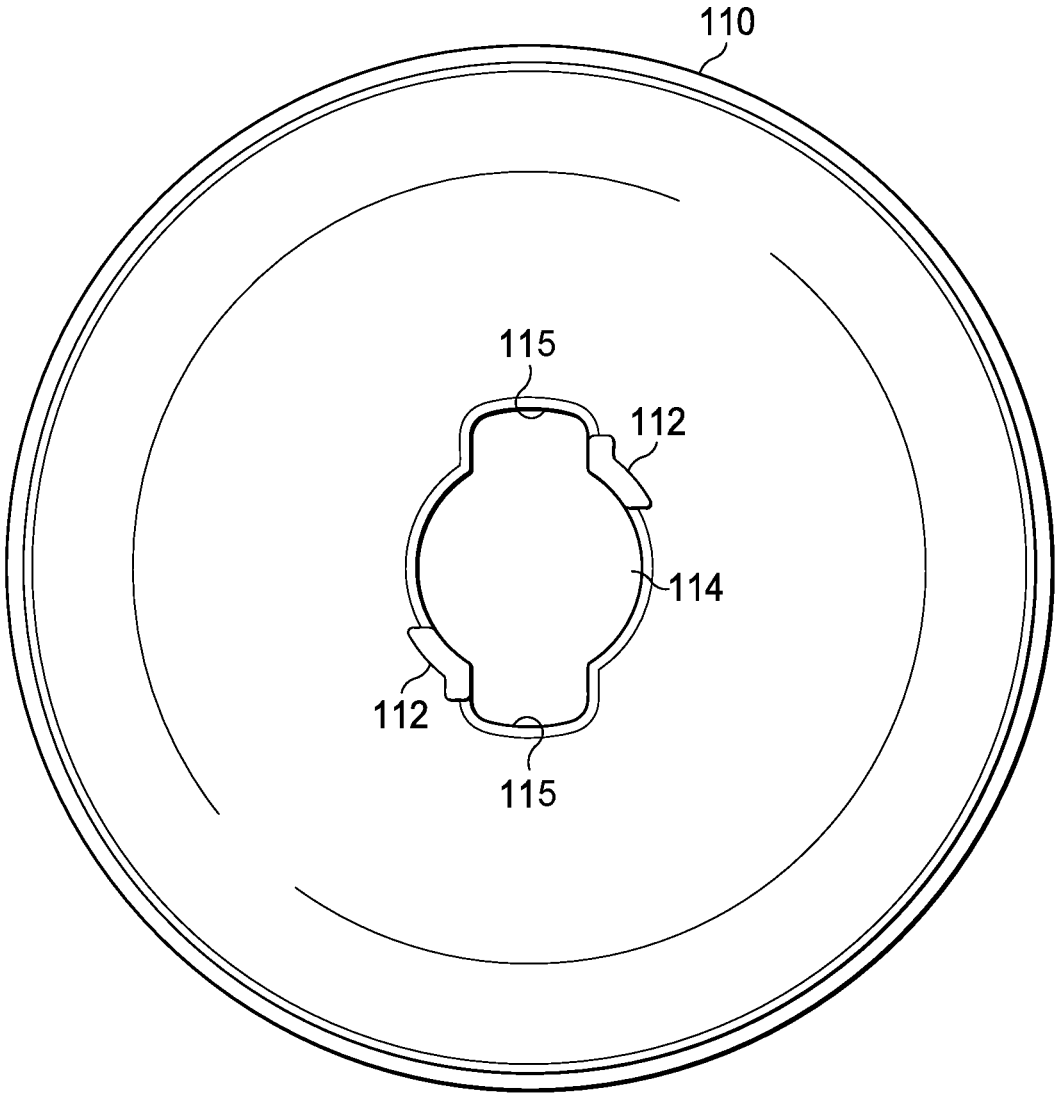
FIG. 8B illustrates a bottom view of a container of an apparatus for storing and extracting an edible substance in accordance with various embodiments of this disclosure.

FIG. 8A illustrates a top view of the container 110 and FIG. 8B illustrates a bottom view of the container 110 in accordance with various embodiments of the present disclosure. FIGS. 8A and 8B show the placement of the stops 112 adjacent to the aperture 114 and cutouts 115. These figures also show the shape of the aperture 114 which complements the protrusions 108 when the stem 104 is moved to an unlocked position and the location of the aperture 114 in the center of the container 110. The generally circular shape of the aperture 114 also allows for the peg 118 of the platform 116 to be inserted through the aperture 114 for coupling with the stem 104.

Figure 9:
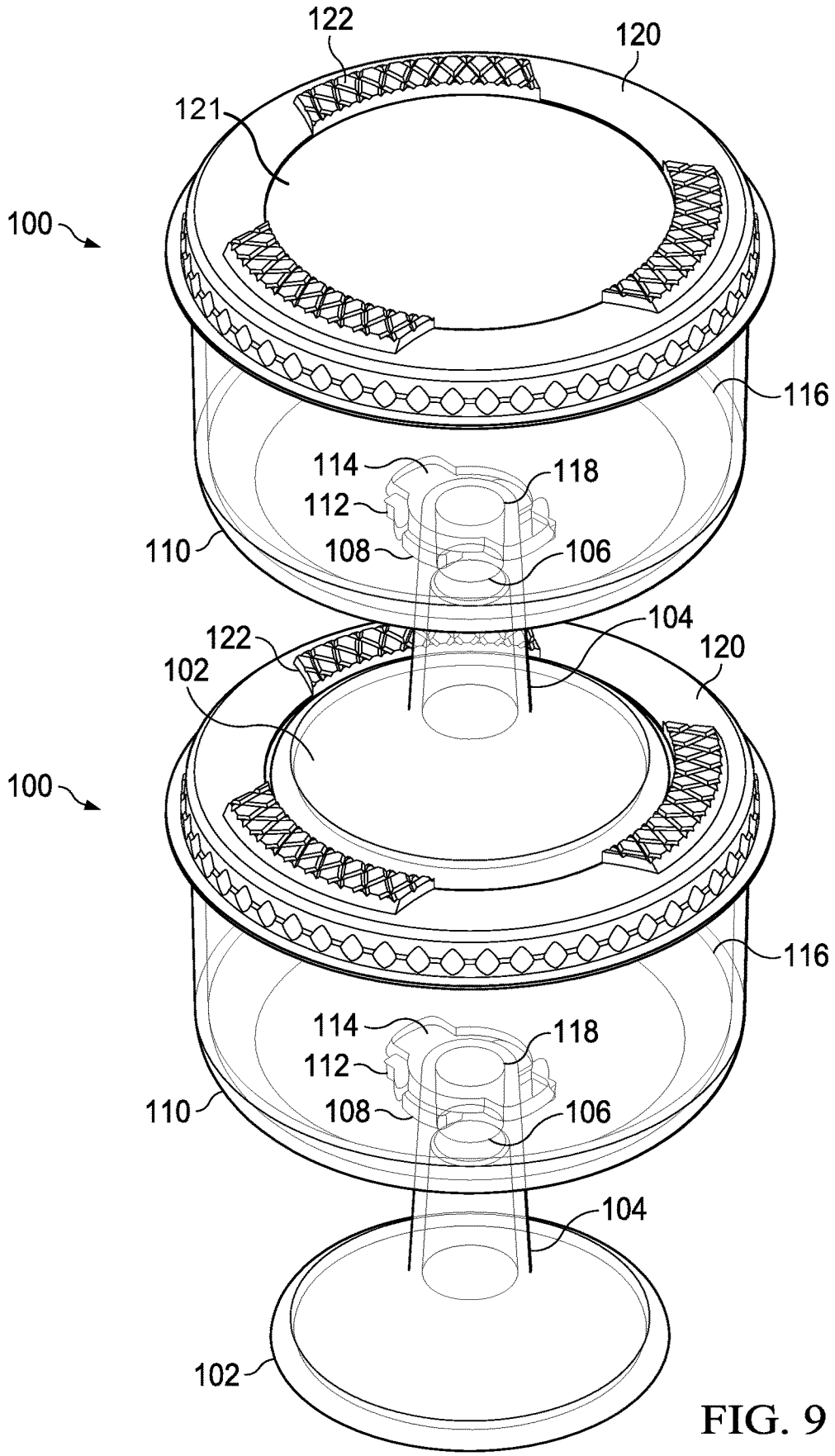
FIG. 9 illustrates a perspective view of multiple apparatuses for storing and extracting an edible substance in a stacked arrangement in accordance with various embodiments of this disclosure.

FIG. 9 illustrates a perspective view of multiple apparatuses for storing and extracting an edible substance in a stacked arrangement in accordance with various embodiments of this disclosure. As shown in FIG. 9, the base 102 of one apparatus 100 fits within the raised ribs 122 located above the lid 120 of another apparatus 100, and in the center portion 121 of the other apparatus 100. The base 102 and ribs 122 are designed in a manner that allows for the stacking of multiple apparatuses before the user consumes the edible substance. Stacking the apparatuses in this manner provides a stable method for storing the edible substance before consumption and prevents the edible substance from spilling out of the container 110. In some embodiments, such as shown in FIG. 9, the lid 120 includes a plurality of raised ribs 122, such as three raised ribs 122 spaced equidistantly at locations around a perimeter of the center portion 121 of the lid 120 in which the base 102 of another apparatus 100 can be placed. The plurality of raised ribs 122 prevent the stacked apparatus 100 from sliding off the lid 120 of the lower apparatus 100. In some embodiments, the center portion 121 also is indented or depressed, to further reduce the movement of the base 102 of the stacked apparatus 100. In some embodiments, a single raised rib 122 surrounding the perimeter of the center portion 121 of the lid 120 can be used to prevent movement of the base 102 of the stacked apparatus 100. In some embodiments, the lid 120 includes the indented or depressed center portion 121 and does not include the raised ribs 122.

Figure 10:
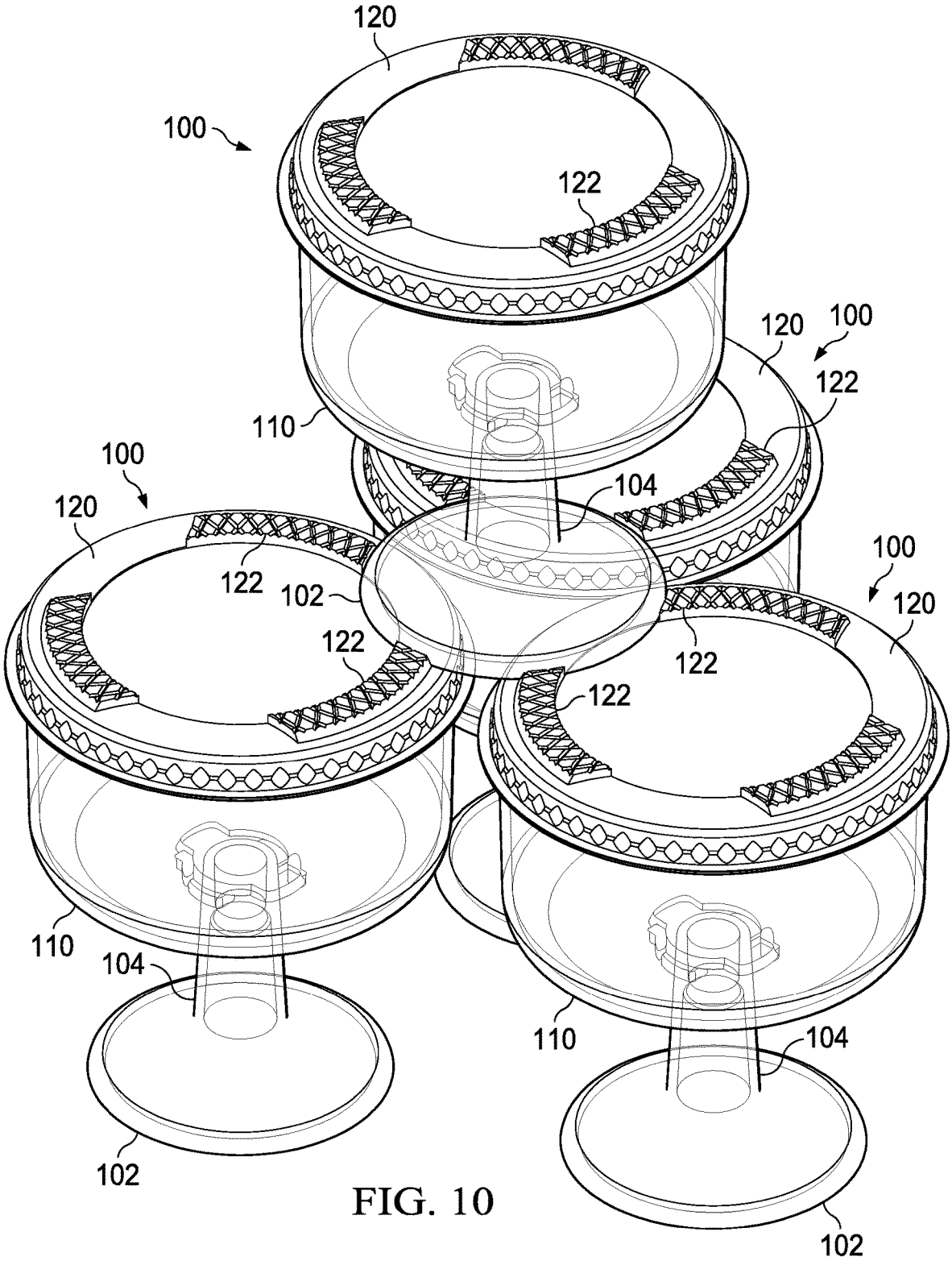
FIG. 10 illustrates a perspective view of multiple apparatuses for storing and extracting an edible substance in a stacked pyramid arrangement in accordance with various embodiments of this disclosure.

FIG. 10 illustrates a perspective view of multiple apparatuses for storing and extracting an edible substance in a stacked pyramid arrangement in accordance with various embodiments of this disclosure. As shown in FIG. 10, the base 102 of a first apparatus 100 can be disposed on a top surface of the lid 120 of a plurality of other apparatuses 100 that are in a triangular arrangement and adjacent to one another with the bases 102 of each of the other apparatuses resting on a surface such as a table. The base 102 of the first apparatus rests at outer edges on the lids 120 of the other apparatuses 100 such that the base 102 of the first apparatus is near or contacting the raised ribs 122 of the other apparatuses 100, and such that a portion of the base 102 of the first apparatus is disposed between two of the three raised ribs 122 on each of the other apparatuses 100. A middle portion of the base 102 of the first apparatus can be disposed above a center gap created between the other apparatus 100. The base 102 and ribs 122 are designed in a manner that allows for the stacking of multiple apparatuses before the user consumes the edible substance. Stacking the apparatuses in this manner provides a stable method for storing the edible substance before consumption and prevents the edible substance from spilling out of the container 110.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. An apparatus for storing and extracting an edible substance, comprising:

a container including an opening at a first end of the container and an aperture disposed through a surface at a second end of the container, wherein the opening of the container is operable to receive the edible substance into the container;

a platform disposed within an interior portion of the container and operable to maintain the edible substance received into the opening of the container; and a stem extending from a base to the aperture of the container, wherein the stem is operable to move through the aperture of the container, wherein the platform is operable to move from a first position in the interior portion of the container to a second position within the interior portion of the container in response to movement of the stem through the aperture of the container, wherein the stem includes one or more protrusions extending a distance perpendicular to a direction in which the stem extends from the base to the aperture of the container, wherein the stem is operable to move between a locked state and an unlocked state, wherein, in the locked state, each of the one or more protrusions is adjacent an underside of the surface at the second end of the container, and wherein, in the unlocked state, each of the one or more protrusions is aligned with one or more cutouts of the aperture, and wherein, when the platform is in the second position, the edible substance is positioned for removal from the platform and from the container.

2. The apparatus of claim 1, wherein the first position of the platform is adjacent the surface at the second end of the container and the second position of the platform is adjacent the opening at the first end of the container.

3. The apparatus of claim 1, wherein the platform is coupled to the stem through the aperture of the container.

4. The apparatus of claim 3, wherein, to couple the platform to the stem through the aperture of the container, the platform includes a peg operable for insertion through the aperture of the container and the stem includes a cavity operable to receive the peg inserted through the aperture of the container.

5. The apparatus of claim 1, wherein the one or more cutouts correspond to a shape of the one or more protrusions of the stem, and wherein alignment of the one or more protrusions of the stem with the one or more cutouts of the aperture allows the one or more protrusions to pass through the one or more cutouts, and allows the stem to move through the aperture to move the platform from the first position to the second position.

6. The apparatus of claim 5, wherein the stem is rotatable between the locked state and the unlocked state.

7. The apparatus of claim 5, further comprising one or more stops disposed on the underside of the surface at the second end of the container, wherein, in the locked state, the one or more protrusions of the stem contact the one or more stops.

8. The apparatus of claim 1, further comprising a lid operable to be coupled to the container at the first end of the container to seal the opening of the container.

9. The apparatus of claim 8, wherein the lid includes one or more raised ribs disposed on an exterior surface of the lid.

10. The apparatus of claim 9, wherein the exterior surface of the lid includes an indented center portion operable to receive a base of another apparatus for storing and extracting an edible substance, wherein each of the one or more raised ribs are disposed around at least a portion of a perimeter of the indented center portion of the lid, and wherein the lid maintains the other apparatus in a stacked position.

11. The apparatus of claim 9, wherein portions of the base are operable to be stacked simultaneously on lids of a plurality of other apparatuses for storing and extracting an edible substance, wherein, when stacked, the portions of the base are each disposed between raised ribs of the lids of each of the plurality of other apparatuses.

12. The apparatus of claim 1, further comprising a lid operable to be coupled to the container at the first end of the container to seal the opening of the container, wherein the lid includes:

an indented center portion on an exterior surface of the lid, the indented center portion operable to receive a base of another apparatus for storing and extracting an edible substance, and one or more raised ribs each disposed around at least a portion of a perimeter of the indented center portion of the lid, wherein the platform includes a peg operable for insertion through the aperture of the container and the stem includes a cavity operable to receive the peg inserted through the aperture of the container to couple the platform to the stem, wherein one or more stops are disposed on the underside of the surface of the second end of the container and the one or more protrusions contact the one or more stops when the stem is in the locked state, wherein the one or more cutouts correspond to a shape of the one or more protrusions of the stem, and wherein alignment of the one or more protrusions of the stem with the one or more cutouts of the aperture allows the one or more protrusions to pass through the one or more cutouts, and allows the stem to move through the aperture to move the platform from the first position to the second position, wherein the first position of the platform is adjacent the surface at the second end of the container and the second position of the platform is adjacent the opening at the first end of the container.

* * * * *